US009433948B2

(12) United States Patent
Kusumoto et al.

(10) Patent No.: US 9,433,948 B2
(45) Date of Patent: Sep. 6, 2016

(54) CENTRIFUGE HAVING ROTOR AND COOLING DEVICE FOR COOLING ROTOR

(71) Applicant: HITACHI KOKI CO., LTD., Tokyo (JP)

(72) Inventors: Shoji Kusumoto, Hitachinaka (JP); Tatsuya Konno, Hitachinaka (JP); Ryou Murayama, Hitachinaka (JP); Yuki Hodotsuka, Hitachinaka (JP); Yuki Shimizu, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 303 days.

(21) Appl. No.: 13/942,097

(22) Filed: Jul. 15, 2013

(65) Prior Publication Data

US 2014/0024516 A1 Jan. 23, 2014

(30) Foreign Application Priority Data

Jul. 18, 2012 (JP) ..... 2012-159372
Jun. 5, 2013 (JP) ..... 2013-119341

(51) Int. Cl.
*B04B 13/00* (2006.01)
*B04B 15/02* (2006.01)

(52) U.S. Cl.
CPC ..... *B04B 15/02* (2013.01); *B04B 13/00* (2013.01)

(58) Field of Classification Search
CPC ..... B04B 13/00; B04B 15/02
USPC ..... 494/1, 10, 14, 37
See application file for complete search history.

(56) References Cited

U.S. PATENT DOCUMENTS 4,850,203 A * 7/1989 Okada ..... F24F 11/08 62/209
6,679,821 B1 * 1/2004 Numata ..... B04B 13/00 494/10

FOREIGN PATENT DOCUMENTS

JP 05-228400 A 9/1993
JP 05-228401 A 9/1993
JP 05228401 A * 9/1993
JP 2012-011358 A 1/2012
JP 2012011358 A * 1/2012

OTHER PUBLICATIONS

JP 05228401 AIPN machine translation.*
JP 2012011358 AIPN machine translation.*

* cited by examiner

*Primary Examiner* — Charles Cooley
*Assistant Examiner* — Shuyi S Liu
(74) *Attorney, Agent, or Firm* — McDermott Will & Emery LLP

(57) ABSTRACT

A centrifuge including a temperature sensor measuring ambient temperature is provided. Centrifugation operation is available or not is determined in accordance with a type of a rotor, the ambient temperature, or operation conditions set by a user. When it is inoperable, a display device displays that it is inoperable so as to invite the user to select necessity of modification of the operation conditions. Upon the display, modified operation conditions which are candidates of operable operation conditions are displayed to let the user select a candidate. To operate under the selected setting operation conditions, the display device displays that the operation is working under modified conditions.

20 Claims, 13 Drawing Sheets

Prior Art

Prior Art

CENTRIFUGE HAVING ROTOR AND COOLING DEVICE FOR COOLING ROTOR

CROSS-REFERENCE TO RELATED APPLICATION

The present application claims priorities from Japanese Patent Application No. 2012-159372 filed on Jul. 18, 2012, and Japanese Patent Application No. 2013-119341 filed on Jun. 5, 2013, and the contents of which are hereby incorporated by reference into this application.

TECHNICAL FIELD OF THE INVENTION

The present invention relates to a centrifuge, that is, a centrifugal separator, in which a rotor is rotated at high speeds as being cooled, in particular, to a centrifuge with an improved method of controlling a cooling device.

BACKGROUND OF THE INVENTION

In a centrifugal separator, for example, a culture solution, blood, or the like as a sample is poured into a rotor via a tube or a bottle, and the rotor is rotated at high speeds to separate and purify the sample. The rotor has a rotation speed variously set depending on the use purpose, and a group of products from a low speed on the order of several thousand rotations per minute (rpm) to a high speed with a maximum rotation speed of 150,000 rpm have been provided according to use purposes. Rotors for use have various types, such as an angle rotor with a tube hole being of a fixed angle type that can support a high rotation speed and a swing rotor with a tube-inserted bucket swinging from a vertical state to a horizontal state according to the rotation of the rotor. Also, rotors have various sizes, such as a rotor applying a high centrifugal acceleration to a small amount of sample by rotation at an ultra-high rotation speed and a rotor that can handle a large amount of sample although the rotation speed is low. Any of these rotors is selected according to the sample to be separated. Therefore, the rotor is configured so as to be attachable to and removable from the rotating shaft of a driving unit such as a motor, and can be replaced.

When the rotor rotates at a high speed in the air, the temperature of the rotor increases by frictional heat with air (windage loss). Depending on the sample to be separated, the temperature has to be kept low. Therefore, a centrifugal separator in which the rotor is cooled during operation has been widely used. A cooling centrifugal separator has a main body provided with a cooling device (such as a freezing device configured of an evaporator, a compressor, a condenser, and an expansion valve). The inside of a rotor chamber is cooled by letting a refrigerant flow through a copper pipe wounded around the outer perimeter of a bowl at an outer wall of the rotor chamber, thereby indirectly cooling the rotor. In a cooling centrifuge, as also described in Patent Document 1 (Japanese Patent Application Laid-Open Publication No. 2012-11358), temperature conditions capable of controlling the temperature of the rotor are described in an instruction manual. In general, the rotor can be used but temperature control by the rotor may not be possible within the specifications. The use environment temperature is room temperatures from 2° C. to 40° C. Of these, performance-assured temperatures with which it is assured that temperature control by the rotor can be within the specifications are room temperatures from 15° C. to 25° C.

Here, the structure of a conventional centrifugal separator is described by using FIG. 12. The centrifugal separator is provided with a bowl 2 formed of a metal thin plate inside a casing 6 made of a box-shaped sheet metal. The bowl 2 and a door 5 define a rotor chamber 3, and the rotor chamber 3 is sealed with a door packing 12. A rotor 1 holds a sample to be separated and rotates the sample at high speed. The rotor 1 has a plurality of holes (not shown) formed for insertion of a tube or the like for pouring the sample, and is supported by a rotating shaft of a motor 4 as a driving part. The rotor 1 is rotated by the motor 4, and the rotation of the motor 4 is controlled by a control device 114. The door can rotate in a vertical direction with a hinge 11 being taken as a center axis. At the rear of the door 5, an operation panel 13 is placed for a user to input conditions such as a rotation speed of the rotor and a separation time and to display various information items. The operation panel 13 can function as both a display unit and an input unit when a so-called touch-panel liquid crystal display device is used.

The rotor chamber 3 is configured so that an opening on an upper side can be sealed by the door 5. With the door 5 open, the rotor 1 can be attached to or removed from the inside of the rotor chamber 3. The bowl 2 has an outer perimeter around which a copper pipe 7*c* as an evaporator is wounded in a spiral shape. The copper pipe 7*c* has an outer perimeter surrounded by a cylindrical insulating material 17. At a lower part of a main body of the centrifugal separator, a freezing device 107 configured to include a condenser 7*a* and a compressor 107*b* is placed, and the copper pipe 7*c* is connected to the compressor 107*b*. Also, an air-blowing device 10 is installed at a back surface of the main body for heat dissipation of the freezing device 107, taking a wind in from an intake port 8 opening at a bottom part of the front surface of the main body and exhausting air from an exhaust port 9. Arrows in FIG. 12 show an air flow from the intake port 8 to the exhaust port 9 through the condenser 7*a*. A refrigerant is sent from the compressor 107*b* into the condenser 7*a*, and the cooled refrigerant is liquefied by the condenser 7*a* and the air-blowing device 10. The liquefied refrigerant is supplied through a capillary 7*d* to the copper pipe 7*c*, and the inside of the rotor chamber 3 is kept constant at a desired temperature set under control by the control device 114 during operation of centrifugation. The temperature of the rotor 1 is monitored by the control device 114 by using an output from a temperature sensor (not shown) installed in the rotor chamber 3.

As the freezing device 107 for use in a centrifugal separator, a reciprocal compressor or a rotary compressor has been generally adopted so far as described in Patent Document 2 (Japanese Patent Application Laid-Open Publication No. 5-228400) and Patent Document 3 (Japanese Patent Application Laid-Open Publication No. 5-228401), and temperature control is performed by ON-OFF control of intermittent driving between operation and stopping, that is, a duty-ratio control. Meanwhile, even in centrifugal separators, not only energy saving and space saving but also high efficiency and ecology are keywords in recent years when customers purchase products.

SUMMARY OF THE INVENTION

As described above, a reciprocal compressor or a rotary compressor is used in a conventional cooling centrifuge, and is under ON-OFF control for temperature control. Also, in general, in the compressor, an increase in temperature increases as the ambient temperature increases. For example, when the ambient temperature increases by 10° C., the temperature of the compressor may increase not by 10° C. but by 20° C. For this reason, in the case of a high-load state and a high ambient temperature, an increase in temperature of the compressor increases and, when the temperature increases too much, the compressor may be broken. Here, an example of rotation frequency of the compressor 107*b* and temperature of the compressor 107*b* at the time of high load in the conventional cooling centrifuge is illustrated in FIG. 13. In the conventional cooling centrifuge, the compressor has a rotation frequency 133 at the time of operation is set constant (here, 50 Hz), and temperature control of the rotor is performed by changing a ratio between an ON time and an OFF time of the compressor 107*b*. For example, when the rotor 1 that is hard to cool is operated at high speed, operation is performed with the compressor being always in an ON state, which represents a maximum capability of the freezing device. When the compressor 107 is continuously rotated, a compressor's temperature 131 substantially linearly increases with an increase in room temperature, as illustrated in the drawing. However, as described above, the use environment temperature of the cooling centrifuge is room temperatures of 2° C. to 40° C. and, of these temperatures, the performance-assured temperatures representing environmental temperature capable of setting temperature control of the rotor within specifications are room temperatures of 15° C. to 25° C. Thus, in a range of high room temperatures of 25° C. to 40° C., the case may occur in which the performance cannot be assured, that is, the rotor cannot be cooled to a set temperature.

However, in the conventional ON-OFF control, as described in Patent Document 2, if the centrifuge is once stopped, the centrifuge cannot be restarted unless a pressure difference between a high pressure side and a low pressure side of the cooling device is eliminated, and therefore the operator has to wait for substantially three minutes from the stop to restart. Therefore, fine temperature control cannot be performed. For example, when the output is desired to be 90%, an OFF time of three minutes at minimum is required. If the OFF time is three minutes, when the duty ratio is 90%, the ON time is naturally twenty-seven minutes. Thus, the ON time continues for twenty-seven minutes, and therefore fine control cannot be performed. Thus, even if the output is desired to be gradually decreased, the always-ON output of 100% is decreased at a dash to 66% (ON time: six minutes (double the OFF time), OFF time: three minutes) due to the restriction described above (an output range near 99% to 67% is an uncontrollable range due to the reason described above). Therefore, temperature control is abruptly changed, and accurate temperature control cannot be performed. Thus, in the end, as illustrated in FIG. 8, the compressor's rotation frequency 133 is required to be selected so that the compressor's temperature 131 does not exceed a compressor's upper-limit temperature 132 even if the centrifuge is used with an output of 100%. This indicates that it is required to select a large-sized centrifuge with a small increase in temperature of the centrifuge even under a high room temperature and in a high-load state, that is, with a large freezing capability, which is oriented in a direction away from energy saving and space saving described above.

As described above, as limitation are added to operation of the cooling device due to changes in ambient temperature, users are required to input optimum centrifuge conditions in consideration of such limitations and it has been difficult for users to set optimum centrifugation operation since availability of operation largely differs depending on the type of the rotor to be used the rotation speed to be set.

The present invention has been made in view of such background explained above. A preferred aim of the present invention is to provide a centrifuge determining operation conditions of the centrifuge set by a user enables operation or not in the ambient environment and under the operation conditions, so that the centrifuge can continue operation by modifying operation conditions when operation is inoperable under the set operation conditions.

Another preferred aim of the present invention is to provide a centrifuge which displays, when operation is not possible under set conditions, candidates of operable operation conditions to a user to let the user select suitable conditions from the candidates.

A preferred aim of the present invention is to provide a centrifuge capable of efficient temperature control using a variable-speed compressor.

Another preferred aim of the present invention is to provide a centrifuge capable of control so that the temperature of the compressor does not reach an upper-limit value by decreasing the rotation frequency of the compressor when room temperature is increased.

Still another preferred aim of the present invention is to provide a centrifuge having a unit reporting, when driving ability of the compressor is being restricted, a user as such.

Still another preferred aim of the present invention is to provide an easy-to-use centrifuge capable of, when a user sets operation conditions of the centrifugation not covered by warranty, easily changing operation conditions following the user's will.

Aspects of the typical ones of the inventions disclosed in the present application will be described as follows.

According to an aspect of the present invention, a centrifuge includes a motor, a rotor mounted on a rotating shaft of the motor, a rotor chamber accommodating the rotor chamber, an input unit inputting operation conditions, and a control device controlling operation of the motor and a cooling device. In the centrifuge, a temperature measuring unit detecting ambient temperature of the centrifuge is provided, the operation conditions include setting temperature and setting rotating speed of the rotor, and the control device determines whether operation is possible or not under the input operation conditions inputted in the input unit according to a type of the rotor and the ambient temperature. The input unit allows input of the type of the rotor to be used and the control device determines whether operation is possible or not based on the type of the rotor inputted to the input unit. Also, a rotor determining unit determining the type of the rotor accommodated in the rotor chamber may be further provided so that the control device determines whether operation is possible based on the type determined by the rotor determining unit. The determination of whether operation is possible or not by the control device is preferably performed before starting operation of the motor.

According to another aspect of the present invention, the centrifuge includes a display device displaying, when the input operation conditions are not operable, that the operation conditions are not operable. Also, when the operation conditions inputted in the input unit are determined to be not operable, the control device instructs the display device to display a screen for allowing resetting of the operation conditions to let a user to select necessity of modification of the operation conditions. When the user selects "necessary" about modification of the operation conditions, the control device instructs the display device to display candidates of modified operation conditions which are operable and accepts selection of a candidate by the user. The modified operation conditions preferably include a combination of a setting rotating speed and a setting time.

According to another aspect of the present invention, the centrifuge includes a cooling device cooling the rotor chamber, and the modified operation conditions include a combination of a setting rotating speed and a setting time of the rotor and setting temperature of the rotor chamber. Here, the control device displays a plurality of plans of the modified operation conditions and performs centrifugation operation in accordance with modified operation conditions selected by the user from the suggestions. The modified operation conditions preferably include a plan in which the setting time is elongated with the setting rotating speed lowered, and a plan in which the setting temperature is raised with the setting rotating speed and the setting time maintained. In addition, the control device instructs the display device to display, when the centrifugation operation is in operation using the modified operation conditions, information indicating that the centrifuge is operating under the modified operation conditions. When it becomes possible to operate under operation conditions that are initially set by the user according to a change in environment (lowered temperature etc.), the control device performs control of changing the corrected operation conditions to the initially set operation conditions so that centrifugation operation is performed under the initially set operation conditions.

According to another aspect of the present invention, when the user selects "continue operation" in a situation in which the control device displays that the operation conditions are not operable, the control device displays information indicating that the operation conditions are not operable and also conditions for improving the not-operable situation on the display device. In addition, when the control device determines that the operation conditions inputted in the input unit are not operable, the control device corrects either or both of the setting temperature and the setting rotating speed and controls the motor and the cooling device.

According to another aspect of the present invention, a centrifuge includes a motor, a rotor mounted on a rotation shaft of the motor, a bowl forming a rotor chamber for accommodating the rotor, a door for sealing up an opening portion of the bowl, a variable-speed-controllable compressor, a cooling device of variable-speed-control type such as inverter control for cooling the bowl by flowing a refrigerant in a pipe wrapped around an outer circumference portion of the bowl, and a control device controlling rotation of the motor and operations of the cooling device. In the centrifuge, a temperature measuring unit is provided at a position at which ambient temperature can be measured or predicted, and an upper-limit rotation frequency allowable upon operating the compressor is set in accordance with the ambient temperature. In addition, the compressor is set with the upper-limit rotation frequency and a lower-limit operation frequency and the compressor is operated continuously or intermittently within a range between the frequencies.

According to another aspect of the present invention, the control device sets switching temperature Tm for switching the upper-limit rotation frequency and setting the upper-limit rotation frequency at a certain value (substantial upper limit of capacity) when the measured ambient temperature is lower than or equal to the switching temperature Tm, and reduces the upper-limit rotation frequency below the certain value when the measured ambient temperature is higher than the switching temperature Tm. For example, the control device computes the upper-limit rotation frequency to be reduced with a function expression of the ambient temperature when the measured ambient temperature is higher than the switching temperature Tm=25° C. In addition, an identifying unit for identifying a type of the rotor mounted on the rotation shaft of the motor may be provided to calculate the upper-limit rotation frequency per the type of the rotor identified.

According to another aspect of the present invention, a setting condition of the upper-limit rotation frequency in accordance with the ambient temperature is previously stored in a memory device per the type of the rotor and the control device read the setting condition of the upper-limit rotation frequency of the rotor identified and operates the cooling device in accordance with the setting condition. Also, a display device for displaying information indicating operation condition is provided to display that "the compressor is in operation in a restricted state" upon lowering the upper-limit rotation frequency. This notification may be any of notification by character information or graphic information on a visual display device such as a liquid crystal display, notification by lighting or blinking an LED or other lamp part, and notification by an auditory part such as sound. Moreover, the control device determines, upon lowering the upper-limit rotation frequency, whether a remaining centrifugation operation time is within a predetermined time or not, and when the remaining centrifugation operation time is within the predetermined time, the control device continues operation of the compressor without lowering the upper-limit rotation frequency.

According to another aspect of the present invention, in the centrifuge, the control device displays modified operation conditions on the display device when the control device determines that inputted operation conditions inputted by a user are not operable. During centrifugation operation, the inputted operation conditions and the modified operation conditions are displayed on the display device. During the centrifugation operation, when the inputted operation conditions become operable, the modified operation conditions are automatically modified into the inputted operation conditions so that the centrifugation operation is continued. To automatically modify the operation conditions during the centrifugation operation or not is preferably settable by the user beforehand. Moreover, a temperature measuring unit for measuring ambient temperature may be provided so that the control device determines whether the inputted operation conditions are operable or not by the measured ambient temperature measured by the temperature measuring unit, and conditions under which the operation can be continued may be calculated in consideration of the ambient temperature.

According to the present invention, since the control device performs a determination of workablity under the inputted operation conditions inputted in the input unit in accordance with a type of the rotor and ambient temperature, it is possible to determine whether or not the operation is performed in such ambient temperature (e.g., room temperature) that exceeds performance warranty temperature for the centrifuge. Thus, it is possible to perform stable and highly reliable centrifugation operation. Also, since the type of the rotor can be determined before starting the centrifugation operation, operability can be highly accurately determined in accordance with the attached rotor. In addition, since a display for allowing resetting of the operation conditions and candidates of modified operation conditions are displayed when the inputted operation conditions are not operable, the user can easily modify the operation conditions only by selecting conditions the user willing to use from the plurality of candidates. The modified operation conditions include a combination of a setting rotation speed and a setting time of the rotor and setting temperature of the rotor chamber. A plurality of plans of the modified operation conditions are displayed, and particularly, a plan in which the setting time is elongated with the setting operation speed lowered and a plan in which the setting temperature is raised with the setting rotation speed and setting time maintained. Thus, the user can select optimum modified operation conditions in consideration of various candidates. Further, when the centrifugation operation is being performed using modified operation conditions, the control device displays information indicating that the centrifuge is in operation under modified operation conditions on the display device during the operation. Moreover, when it becomes possible to operate under initially set operation conditions during the centrifugation operation using the modified operation conditions, the centrifugation operation is performed under the initially set operation conditions instead of the modified operation conditions. Thus, an easy-to-use centrifuge can be achieved.

According to the present invention, when the user selects "continue operation" with not operable conditions, the control device displays that it is not operable and also display conditions for improving the not operable situation on the display device. Thus, it is possible for the user to appropriately respond. Moreover, since the control device automatically modifies when it determines that the operation conditions are not operable, it is possible to continue the operation.

According to the present invention, an inverter freezer is adopted as the cooling device of the cooling centrifuge, and a temperature measuring unit for measuring ambient temperature is provided to set an upper-limit rotation frequency of the compressor in accordance with the ambient temperature. Thus, the capacity of the compressor can be effectively utilized and a compressor with lower power and a smaller size than conventional ones can be adopted and energy saving, downsizing, space saving, etc. of the cooling centrifuge can be achieved. In addition, since the upper-limit rotation frequency and a lower-limit operation frequency are set with the compressor, the operation is continuously or intermittently performed within a range between the frequencies, meticulous temperature control is available and thus the rotor chamber can be highly efficiently cooled. Further, when the measured ambient temperature is higher than switching temperature Tm, the upper-limit rotation frequency is lowered below a certain value, it is possible to efficiently cool down maximally utilizing capacity of the compressor when the measured ambient temperature is lower than or equal to the switching temperature Tm, and an excessive temperature increase of the compressor can be avoided with limiting the capacity of the compressor when the measured ambient temperature is higher than or equal to the switching temperature Tm. Moreover, when the measured ambient temperature is higher than the switching temperature Tm, the control device calculates the upper-limit rotation frequency with a function expression. Thus, appropriate temperature control and operation control of the compressor in accordance with the ambient temperature can be achieved.

As the cooling device, an inverter freezer is adopted, and the compressor has its rotation frequency under variable-speed control.

According to the present invention, since the upper-limit frequency is set per the identified type of the rotor, even when the rotor is exchanged, the capacity of the compressor can be maximally utilized. Also, since setting conditions of the upper-limit rotation frequency corresponding to the ambient temperature are previously stored per the type of the rotor in a memory device, it is possible to quickly select and set the upper-limit rotation frequency suitable for the rotor. Moreover, upon setting the upper-limit rotation frequency, the control device is not required to perform an arithmetic expression, and moreover it is also possible to set the upper-limit rotation frequency to be stored in the memory device optionally at a plurality of stages per a detailed temperature range. Thus, it is possible to respond to carious cased and thus highly accurate management of the upper-limit rotation frequency is available.

According to the present invention, upon lowering the upper-limit rotation frequency, the control device displays on the display device that the centrifuge is in operation with a limitation applied to the compressor. Thus, the user can easily understand that the centrifuge is in operation in a situation in which the capacity of the cooling device is limited. Further, if information (solution) about how to cancel the limitation is displayed to the user, a more-easy-to-use centrifuge can be achieved. Moreover, upon lowering the upper-limit rotation speed, the control device determines whether a remaining centrifugation operation time is within a predetermined time, and the operation of the compressor is continued without lowering the upper-limit rotation frequency when the remaining time is within the predetermined time (e.g., a few minutes remaining). Thus, it is possible to prevent lowering of the capacity of the compressor immediately before termination of the centrifugation operation.

According to the present invention, when the control device determines, before starting the centrifugation operation, that the inputted operation conditions inputted by the user is not operable, the control device displays modified operation condition on the display device and also displays the inputted operation conditions and the modified operation conditions on the display device during the centrifugation operation. Thus, the user can immediately recognize in what conditions the operation is being performed even during the operation. Further, when it becomes possible to operate under the inputted operation conditions during the operation, the conditions are automatically modified so that the operation is continued. Thus, a centrifugation operation with conditions that are close to ideal ones as much as possible is available. Since the automatic modification can be previously selected, it does not affect user who does not wish to change the operation conditions once the operation started, and thus it is possible to use the centrifuge in a manner same as that of conventional ones.

The above and other preferred aims and novel characteristics of the present invention will be apparent from the description of the present specification and the accompanying drawings.

BRIEF DESCRIPTIONS OF THE DRAWINGS

DESCRIPTIONS OF THE PREFERRED EMBODIMENTS

Figure 1:
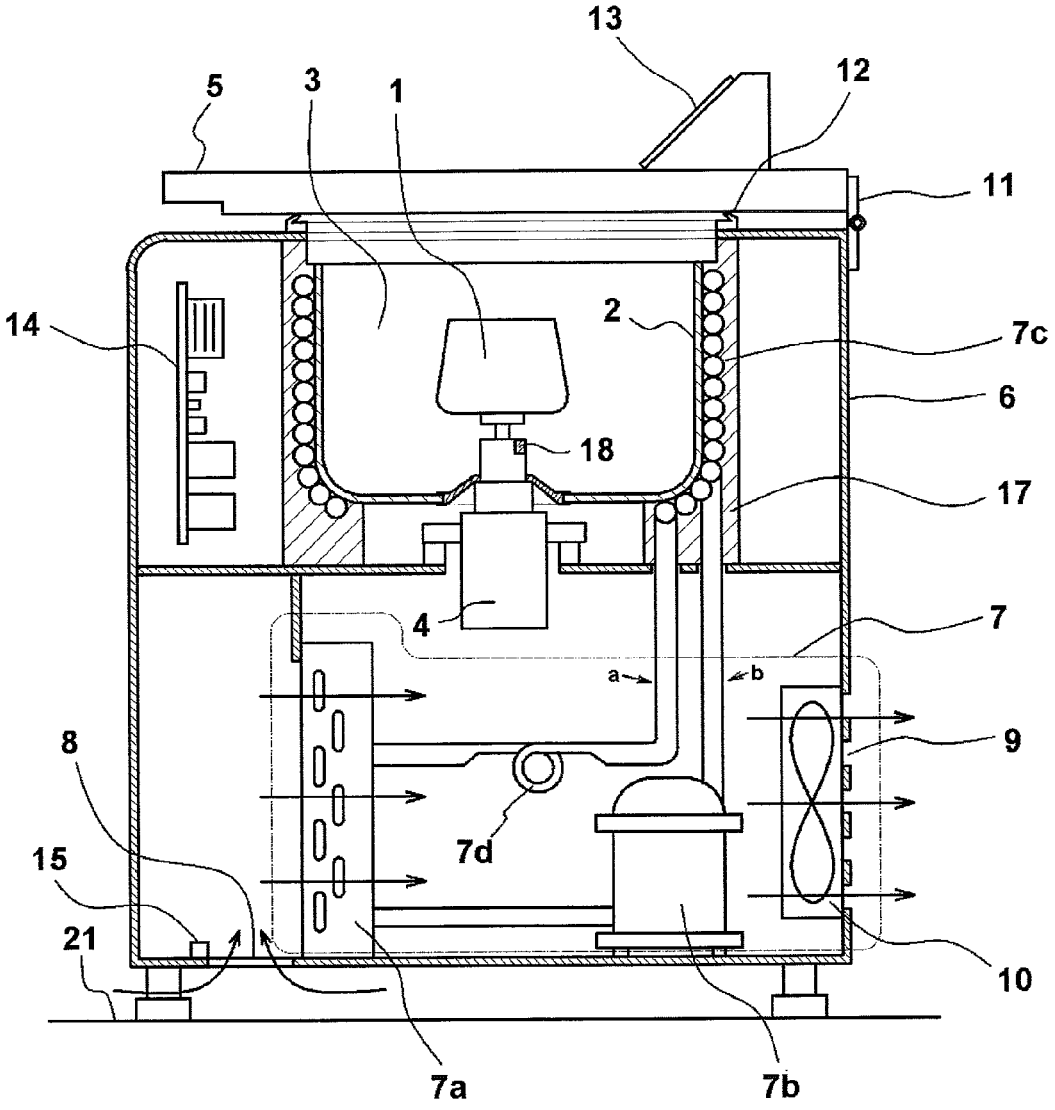
FIG. 1 is a cross-sectional view of an entire structure of a centrifugal separator according to an embodiment of the present invention.
Figure 12:
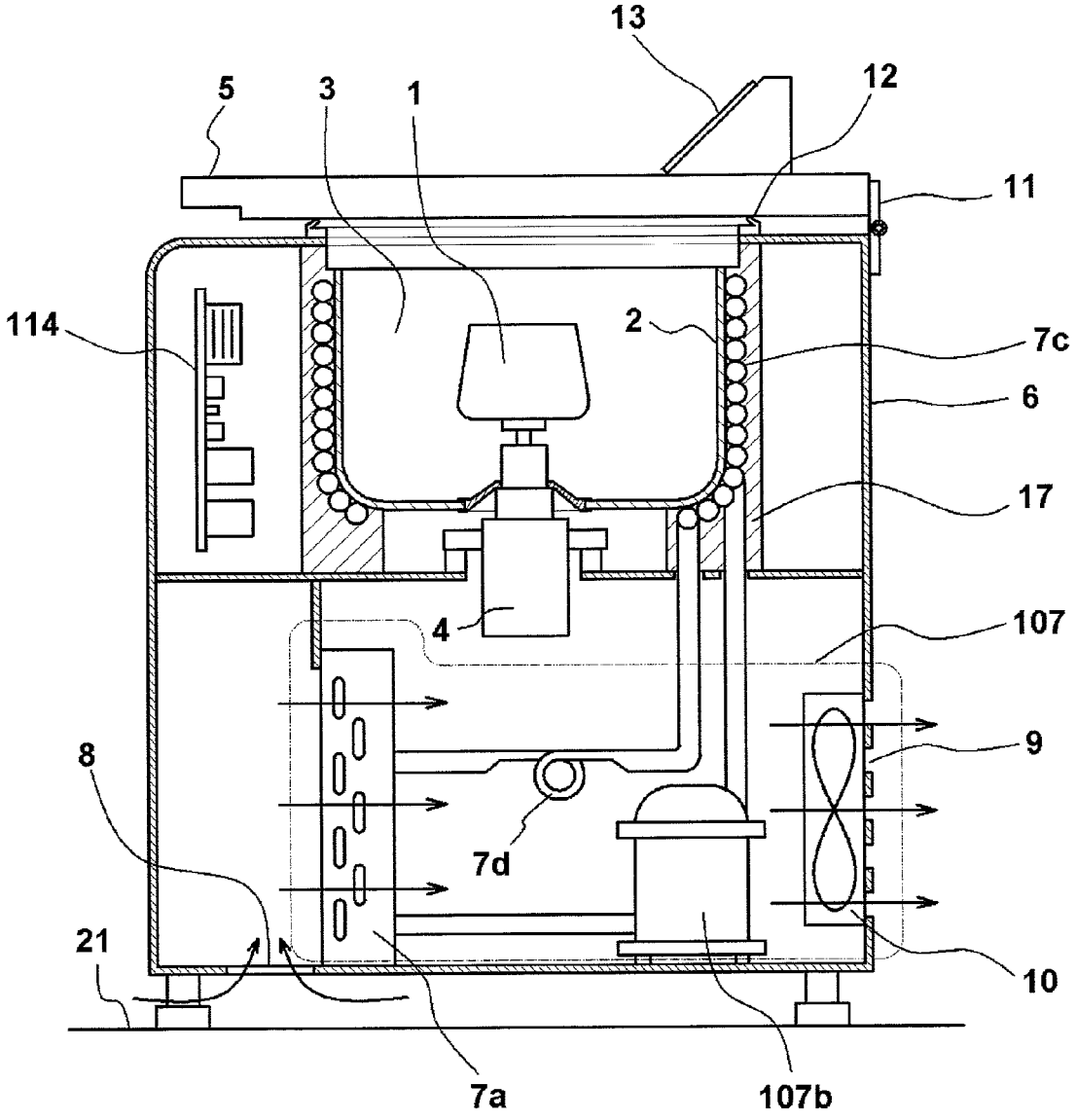
FIG. 12 is a cross-sectional view of an entire structure of a conventional centrifugal separator.
Figure 13:
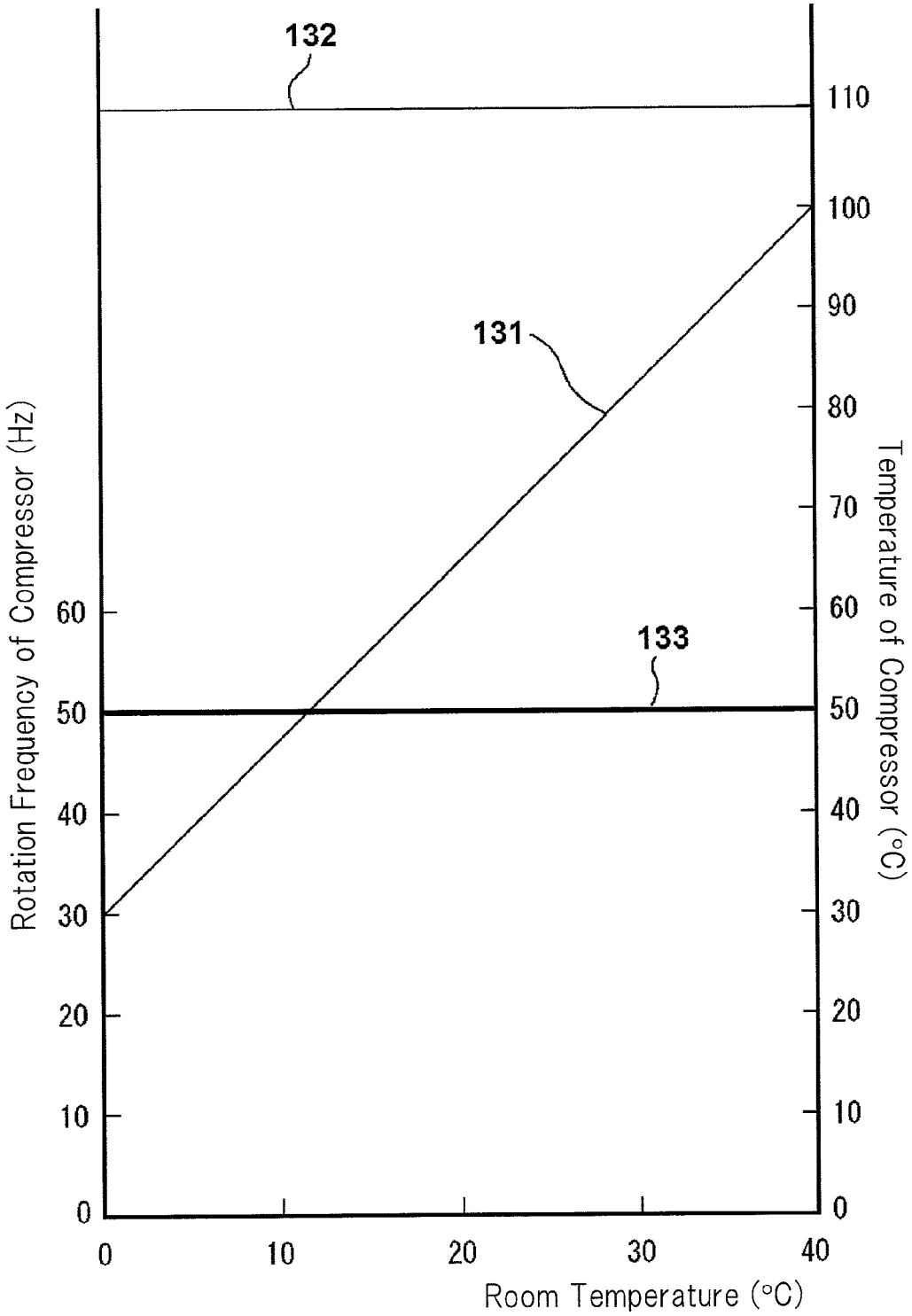
FIG. 13 is a graph illustrating an increase in temperature of a compressor in the conventional centrifugal separator.

Embodiments of the present invention will be described below based on the drawings. FIG. 1 is a cross-sectional view of an entire structure of a centrifuge (a centrifugal separator) according to an embodiment of the present invention. The basic structure of the centrifugal separator is substantially identical to that of the conventional centrifugal separator illustrated in FIG. 12 except a freezing device 7 and a control device 14, and identical portions are provided with same reference characters and are not repeatedly described herein. Like FIG. 12, arrows in FIG. 1 show an air flow from the intake port 8 to the exhaust port 9 through the condenser 7*a*.

In the present embodiment, a rotary compressor is adopted as a compressor 7*b* of the freezing device (cooling device) 7. With inverter control by the control device 14, the rotation frequency of the compressor 7*b* is controlled so as to be variable in speed. The control device 14 is configured to have a microcomputer and a storage device not shown. With a computer program being executed, each device of the centrifuge is controlled. A temperature sensor 15 is provided near the intake port 8 opening at the bottom of the front of the centrifugal separator, thereby measuring ambient temperature of the centrifugal separator. The temperature sensor 15 is a detecting unit configured to directly measure or able to predict ambient temperature, and can be configured by using, for example, a thermocouple or a resistance thermometer, and its output is transmitted via a signal line not shown to the control device 14. The position where the temperature sensor 15 is provided is not restricted to the position illustrated in FIG. 1, but may be any as long as ambient temperature can be measured or predicted. The rotor 1 in the rotor chamber 3 can be selected according to a rotating sample container and mounted on the rotating shaft of the motor 4. The rotor 1 is provided with identification information via a known scheme, and the identification information is read by an ID sensor provided near the rotating shaft. For example, the identification information to be provided on a rotor 1 side is configured by arrangement of a plurality of permanent magnets, and an ID sensor 18 is configured of a magnetic sensor such as a Hall IC. An output from the ID sensor 18 is transmitted to the control device 14 via a signal line not shown.

In the present embodiment, if room temperature, that is, ambient temperature, measured by the temperature sensor 15 becomes a switch temperature Tm, which is a predetermined threshold, for example, 25° C., and continuous operation of the compressor 7*b* is kept as it is with its upper-limit frequency, the ambient temperature may possibly exceed the upper-limit temperature (performance-assured range) of the compressor 7*b*. Therefore, to suppress an increase in temperature of the compressor 7*b*, the operation frequency of the compressor 7*b* is controlled by the control device 14 so as to be decreased according to an increase in ambient temperature. As such, if the ambient temperature exceeds the switch temperature Tm, the set upper-limit rotation frequency of the compressor 7*b* is decreased, and therefore cooling capability goes down compared with the case in which the room temperature is lower than or equal to switch temperature Tm. However, since stopping the centrifuge in the course of operation due to high room temperature should be avoided, the present embodiment is configured so that a maximum cooling capability under the room temperature is kept although the operation is under the restriction with the set upper-limit rotation frequency being decreased. As such, the control device 14 sets the switch temperature Tm for switching the upper-limit rotation frequency and, the upper-limit rotation frequency is set to a certain value (a substantial upper limit of capability) when the measured ambient temperature is lower than or equal to the switch temperature Tm, and the upper-limit rotation frequency is decreased from the constant value when the measured ambient temperature is higher than the switch temperature Tm. For example, when the measured ambient temperature is higher than the switch temperature Tm=25° C., the control device calculates an upper-limit rotation frequency to be reduced with a function expression of the ambient temperature. Note that in the structure of FIG. 1, the compressor 7*b* is not restricted to a rotary compressor but may be another variable-speed-controllable compressor as long as the operational frequency can be variably controlled under inverter control by the control device 14.

Figure 2:
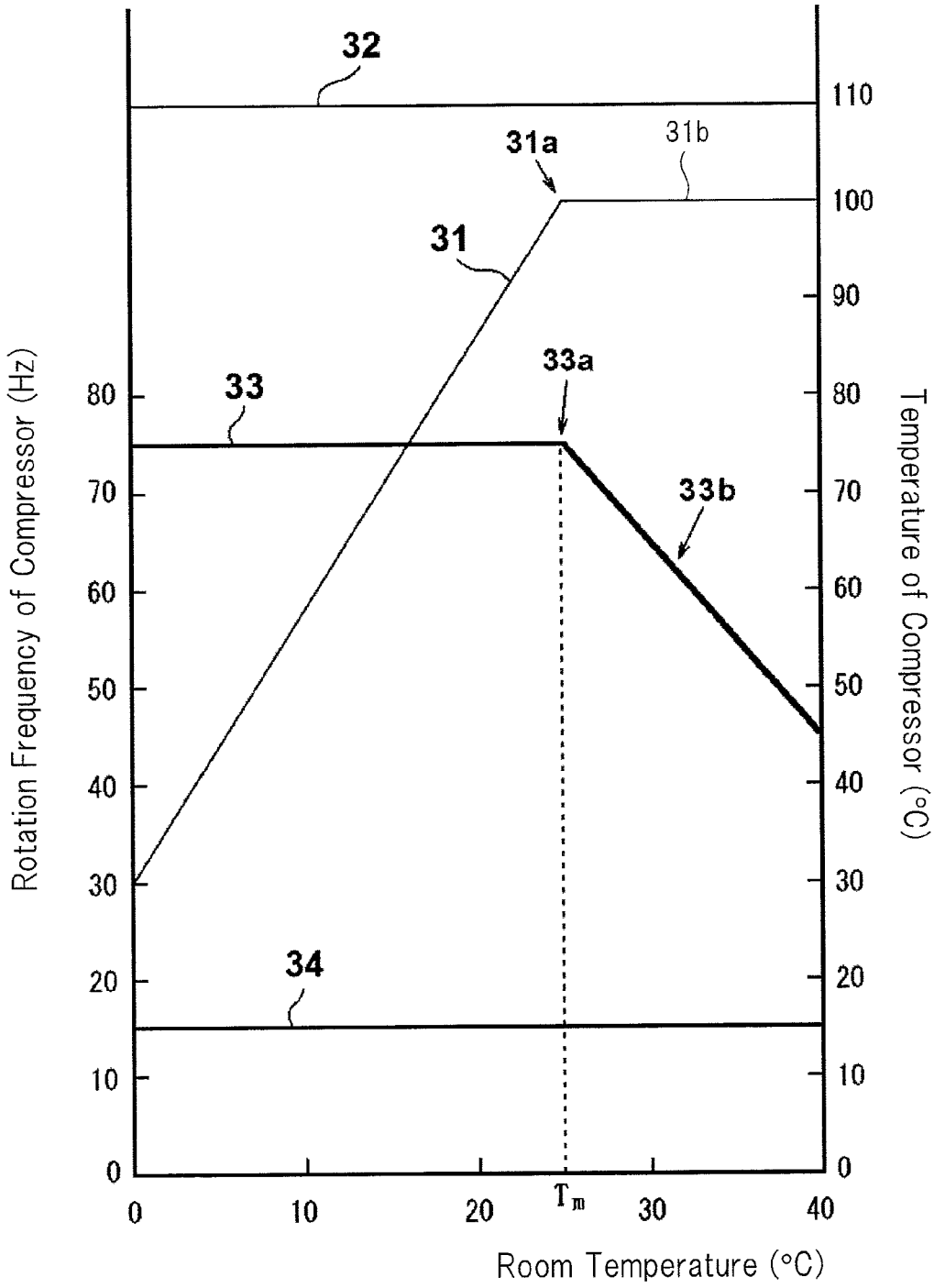
FIG. 2 is a graph illustrating a rotation frequency of a compressor and temperature increase characteristics between room temperature and the compressor, according to the embodiment of the present invention.

FIG. 2 is a graph illustrating a rotation frequency of a compressor and temperature increase characteristics between room temperature and the compressor, according to the embodiment of the present invention. The vertical axis on the left side represents rotation frequency of the compressor (units: Hz). The compressor 7*b* of a variable-compressor type has usable upper-limit frequency and lower-limit frequency set by the rating, and operation is performed within a range between these upper limit and lower limit. When the compressor is used as being incorporated in a centrifugal separator, the frequency range in actual use is set according to various situations such as the capability of the condenser 7*a* and the noise level. In the present embodiment, a rotational-frequency upper-limit value 33 of the compressor 7*b* is set at 75 Hz when the room temperature is lower than or equal to 25° C. and, when the room temperature exceeds 25° C., the upper-limit frequency is linearly decreased according to an increase in temperature. That is, if the ambient temperature is Ta, when Ta≤25° C., upper-limit value $F_{cmax}$=75 (Hz), and when Ta>25° C., upper-limit value $F_{cmax}$=f(Ta) (Hz).

In FIG. 2, f(Ta) can be calculated by a linear function with a negative gradient, that is, f(Ta)=−2Ta+125, and the rotation frequency has an upper-limit value 33 as indicated by an arrow 33*b*. On the other hand, a lower-limit frequency of the rotation frequency of the compressor 7*b* is constant at 15 Hz irrespective of room temperature.

Figure 8:
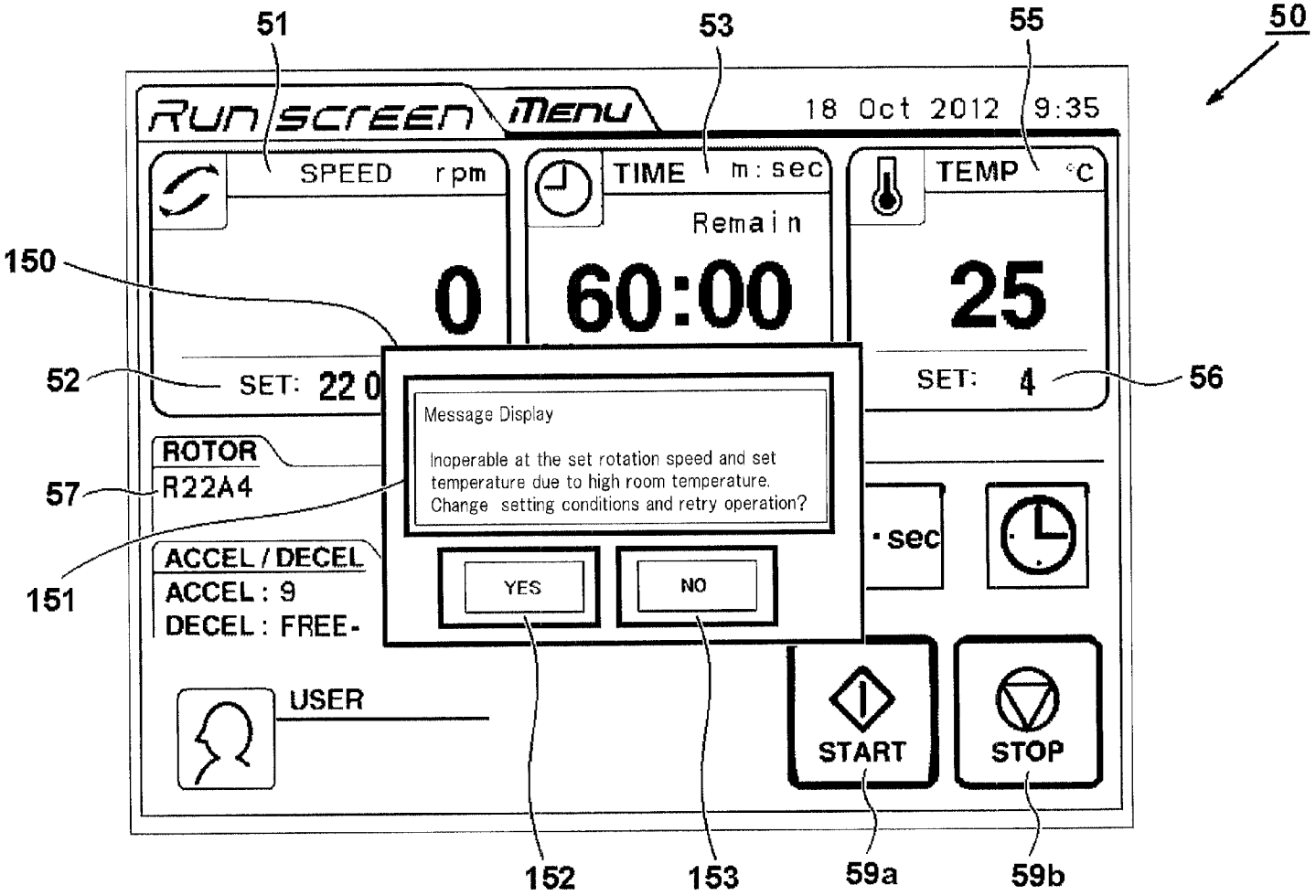
FIG. 8 is a diagram of a display screen of a centrifuge according to the third embodiment of the present invention, illustrating a state in which a message of inoperability is displayed.

As such, control is performed so that the rotational-frequency upper-limit value 33 of the compressor 7*b* is decreased when the ambient temperature (room temperature) Ta becomes higher than or equal to the predetermined threshold temperature (switch temperature Tm) indicated by an arrow 33*a*. Therefore, a compressor's temperature 31 at the time of continuous operation with the rotational-frequency upper-limit value 33 reaches an allowable upper-limit temperature of substantially 100° C. when the room temperature is 25° C. as indicated by an arrow 31*a*. However, even if the room temperature increases more than 25° C., the rotational-frequency upper-limit value 33 of the rotation frequency is decreased, and therefore substantially 100° C. can be kept as indicated by an arrow 31*b*. Normally, the compressor has its usable performance-assured range set, and a compressor's upper-limit temperature 32 is set for that range. In the compressor 7*b* of the present embodiment, within a range of ambient temperatures of 0° C. to 40° C., 110° C. is a rated upper-limit value as indicated by the compressor's upper limit temperature 32. However, in the present embodiment, in consideration of a margin and life, 100° C. is set as a practical upper-limit value with a margin on the order of 10%, and a further increase in temperature is prohibited. Note that an increasing gradient at the compressor's temperature 31 of FIG. 2 lower than or equal to 25° C. is higher than an increase in temperature of the compressor's temperature 131 in the conventional centrifuge illustrated in FIG. 8 and is severe in temperature. This is because a small-sized freezing device with a freezing capability lower than that of the freezing device of FIG. 8 is adopted and the compressor 7*b* is rotated at high speed.

Figure 3:
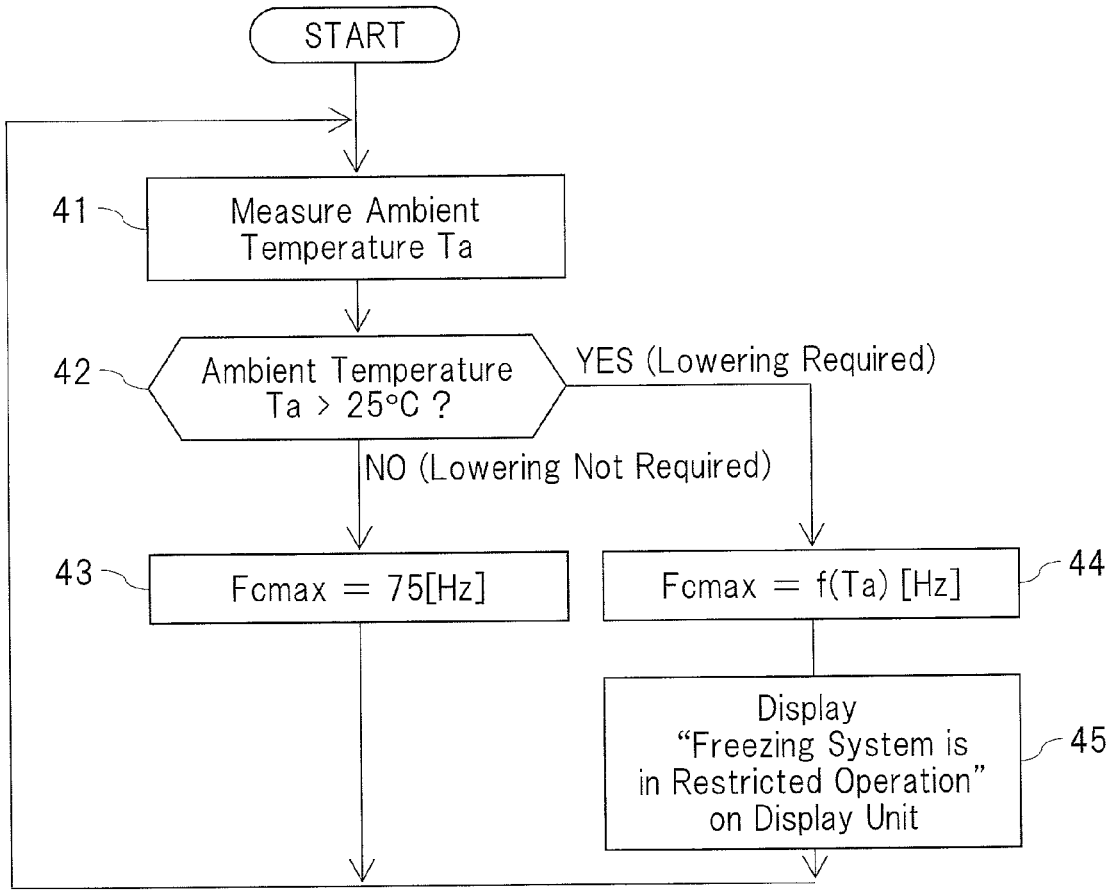
FIG. 3 is a flowchart of a control procedure of a cooling device according to the embodiment of the present invention.

Next, the control procedure of the freezing device 7 of the present embodiment is described by using the flowchart of FIG. 3. A series of processes of the procedure illustrated in FIG. 3 can be performed as software by a program stored in advance in the storage device of the control device 14. The procedure illustrated in FIG. 3 is performed when the freezing device 7 is activated. First, when the freezing device 7 is activated, the procedure of FIG. 3 is performed. First, the control device 14 measures the ambient temperature (room temperature) Ta by using the temperature sensor 15 (step 41). Next, the control device 14 determines whether the ambient temperature Ta exceeds 25° C. (step 42). Here, when the ambient temperature Ta exceeds 25° C., the rotational-frequency upper-limit value 33 of the compressor 7*b* is required to be reduced as indicated by the arrow 33*b* of FIG. 2, and therefore the upper-limit value $F_{cmax}$ is calculated by using the predetermined function f(Ta) (step 44). Here, this can be found by $F_{cmax}$=−2Ta+125 (° C.) in the present embodiment. By setting this upper-limit value $F_{cmax}$, the compressor 7*b* is operated. Here, by causing a message to be displayed on the operation panel 13 as a display device, indicating that "the freezing device in restricted operation", thereby calling user's attention. When the ambient temperature Ta does not exceed 25° C. at step 42, the upper-limit value $F_{cmax}$ is set at 75 Hz, and the procedure returns to step 41. The flow illustrated in FIG. 3 is cyclically executed by the control device 14 while the freezing device 7 is being activated, and an optimum rotation frequency is set according to the ambient temperature Ta at the time of execution.

Figure 4:
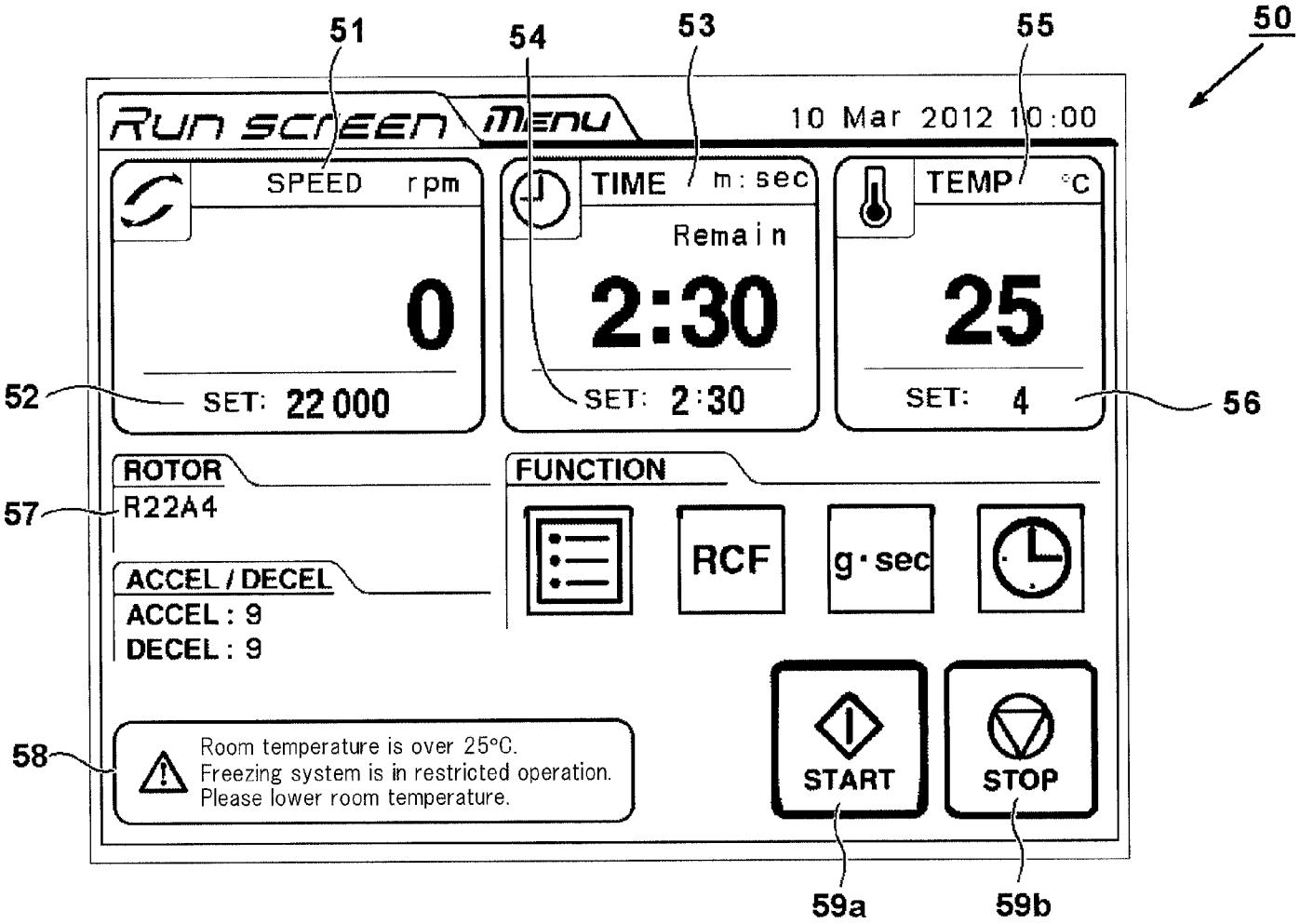
FIG. 4 is a diagram of a display example on an operation panel of the centrifugal separator according to the embodiment.

FIG. 4 is a diagram of an example of a display screen 50 at step 45. FIG. 4 depicts display contents immediately after an operation start switch is turned ON after a user inputs a series of operation conditions. The display screen 50 has an operational rotation count display unit 51, a set rotation count display unit 52, a remaining operation time display unit 53, a setting operation time display unit 54, a current temperature display unit 55, and a set temperature display unit 56. In the present embodiment, the case is described in which the user inputs 22000 rpm as a set rotation count, two hours and thirty minutes as a setting operation time, and 4° C. as a set temperature. Here, the operational rotation count display unit 51, the remaining operation time display unit 53, and the current temperature display unit 55 display a current state. The display screen 50 is further provided with a rotor information display unit 57 for displaying the type of the identified rotor 1, a message display unit 58, a start icon 59*a*, a stop icon 59*b*, and others. As such, information is displayed on the display screen on a real-time basis during centrifuging. On the message display unit 58, a warning message at step 45 of FIG. 3 is also displayed. In this message, not only character information but also an icon for calling attention is preferably displayed. With this, the operator can easily know two things, that is, what causes a problem (the room temperature exceeds 25° C.) and how to solve the problem ("lower the room temperature"). Note that when this message is first displayed, an alarm sound may be issued or a warning lamp or the like may be lit or blinked. While a warning is displayed on the display screen 50 in the present embodiment, various indicator lamps attached to the centrifugal separator, a light remotely provided, or the like may be lit up or blink for notifying a warning state.

As described above, according to the present embodiment, an inverter freezer is adopted as a freezing device (a cooling device) of a cooling centrifuge, and the temperature sensor 15 is provided at a position where an ambient temperature can be measured. When the ambient temperature exceeds 25° C., the operation frequency of the inverter freezer is gradually decreased to continuously decrease the output to suppress an increase in temperature of the compressor. With this, the freezing device 7 to be adopted can have lower inputs and a smaller size than ever, thereby achieving energy saving, small size, space saving, and others of the cooling centrifuge.

The compressor has an upper-limit rotation frequency and a lower-limit rotation frequency set, and is continuously or intermittently operated within a range between these frequencies. Therefore, fine temperature control is possible, and the rotor chamber can be accurately cooled. When the measured ambient temperature is higher than the switch temperature Tm, the upper-limit rotation frequency is reduced from the constant value. Therefore, when the ambient temperature is lower than or equal to the switch temperature Tm, efficient cooling can be performed as making the most of the capability of the compressor. When the ambient temperature is higher than or equal to the switch temperature Tm, an excessive increase in temperature of the compressor can be avoided as restricting the capability of the compressor. Since the control device calculates an upper-limit rotation frequency with a functional equation of the ambient temperature when the measured ambient temperature is higher than the switch temperature Tm, appropriate temperature control and operation control over the compressor according to the ambient temperature can be performed.

Figure 5:
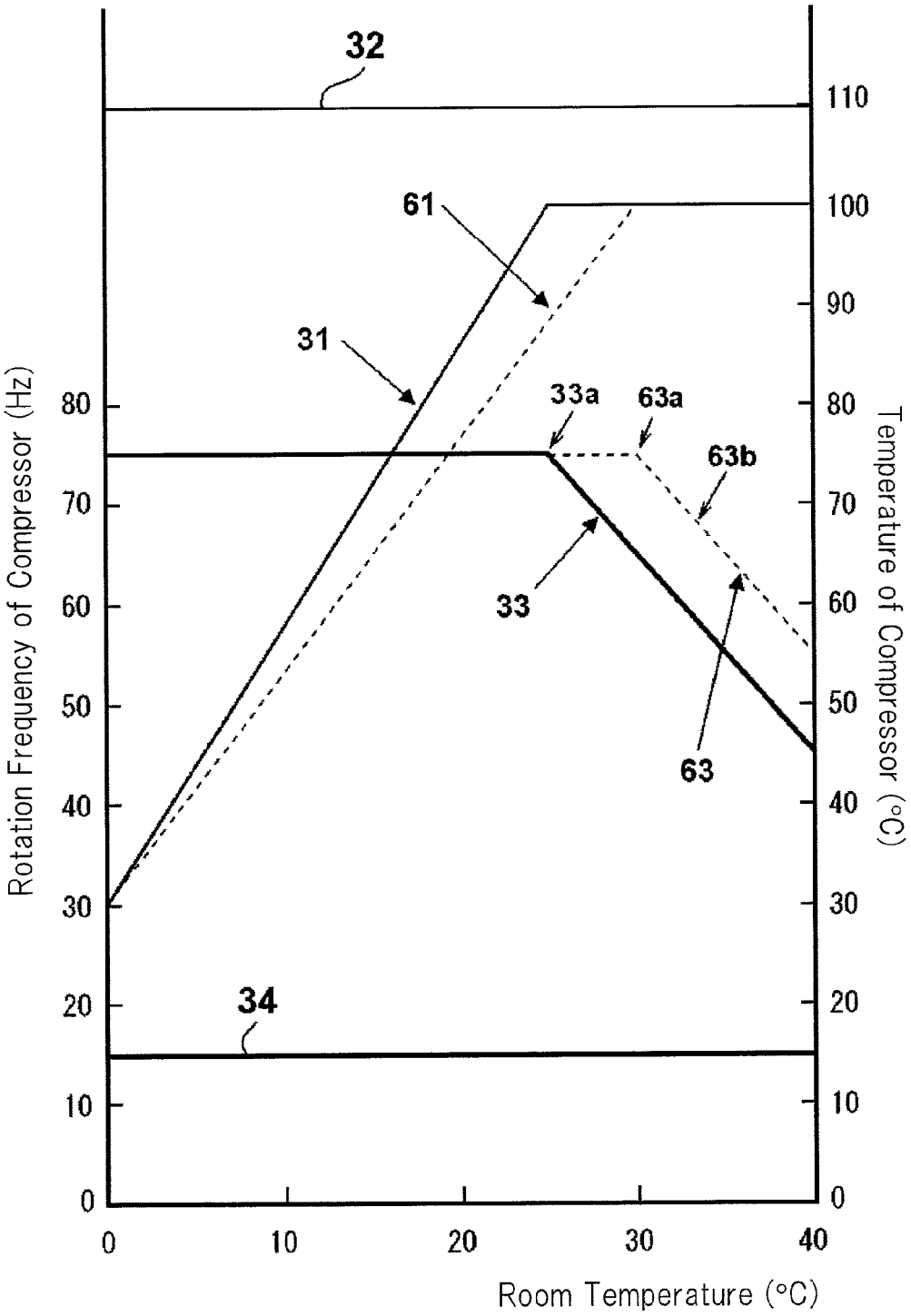
FIG. 5 is a graph illustrating a rotation frequency of a compressor and a temperature increase characteristics between room temperature and the compressor, according to a second embodiment of the present invention.
Figure 6:
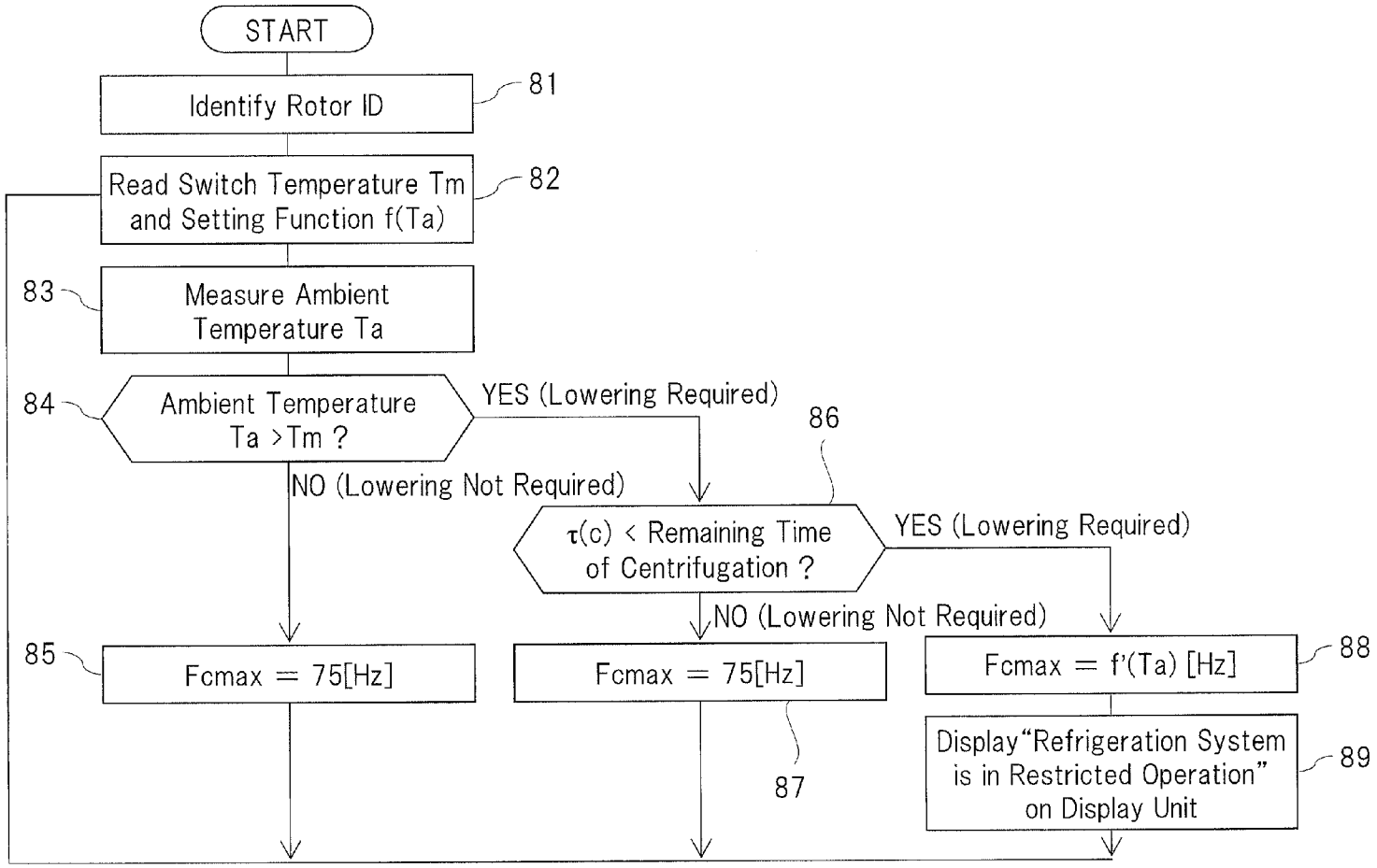
FIG. 6 is a flowchart of a control procedure of a cooling device according to the second embodiment of the present invention.

Next, a second embodiment of the present invention is described by using FIGS. 5 and 6. In the second embodiment, the rotational-frequency upper-limit value 33 of the compressor 7*b* is changed according to not only the room temperature but also the room temperature and the type of the rotor. The rotor 1 is of a removable type, and its size and surface area differ for each rotor. Therefore, even if the rotor 1 is cooled to have the same rotation count and the same target temperature (for example, 4° C.) the load on the compressor 7*b* differs. In the case of a so-called easy-to-cool rotor (which is referred to as a "low-load rotor" herein), the degree of increase in temperature of the compressor 7*b* differs compared with a so-called difficult-to-cool rotor (which is referred to as a "high-load rotor" herein). That is, in the case of the high-load rotor, the temperature of the compressor 7*b* is easy to increase. In the case of the low-load rotor, the degree of increase in temperature of the compressor 7*b* is small compared with the high-load rotor.

Thus, the second embodiment is configured such that a threshold for reducing the upper-limit value of the rotation frequency of the compressor 7*b* is changed according to the type of the rotor. In FIG. 5, the compressor 7*b* for use is the same as that of the first embodiment, and therefore the compressor's upper-limit temperature 32 and the compressor's rotational-frequency lower-limit value 34 are the same as those of the first embodiment. Here, when the rotor 1 is operated at a set cooling temperature of 4° C., the compressor's temperature at that time is increased as indicated a reference numeral 31 in the case of some rotor 1. However, in the case of another easy-to-cool rotor 1, the rotor 1 can be operated with a short operating time at an upper-limit rotation count of 75 Hz or be operated with a rotation count lower than the upper-limit rotation count of 75 Hz, and therefore the compressor's temperature is represented by an rising straight line as indicated by a dotted line representing a compressor's temperature 61 (in the case of a rotor with a low heat value due to windage loss). For this reason, in the case of the easy-to-cool rotor, the operation is possible to the point of time indicated by not an arrow 33*a* but an arrow 63*a* (switch temperature Tm'=30° C.) at the upper-limit rotation count of 75 Hz. Therefore, as indicated by a compressor's rotational-frequency upper limit 63, the rotation count is configured to be 75 Hz by a temperature of 30° C. and is decreased at a predetermined ratio after the temperature exceeds 30° C.

That is, according to the compressor's rotational-frequency upper limit 63, the ambient temperature Ta is assumed as follows:

When Ta≤30° C., upper-limit value $F_{cmax1}$=75 (Hz), and

When Ta>30° C., upper-limit value $F_{cmax1}$=f(Ta)=−2Ta+135.

The lower-limit frequency of the rotation frequency of the compressor 7*b* is constant at 15 Hz irrespective of room temperature. Note that while two patterns, that is, 33 and 63, are illustrated in FIG. 5 as upper limits of the rotation frequency of the compressor, not only two patterns but also any plurality of patterns of upper limits of the rotation frequency of the compressor may be created and each rotor may be associated with any of the patterns.

Next, a control procedure of the freezing device 7 of a second embodiment is described by using a flowchart of FIG. 6. A series of processes of the procedure illustrated in FIG. 6 can be also performed as software by the control device 14. First, when the freezing device 7 is activated, the control device 14 identifies an ID of the rotor 1 from the output of the ID sensor 18 (step 81). This identification can be performed by using a known identifying method. Identification may be performed while the rotor 1 is being stopped, or may be performed by rotating the rotor 1 several times at an extremely low speed. Next, the control device 14 reads the switch temperature Tm as a threshold for decreasing the upper limit (75 Hz) of the rotation frequency and a setting equation f(Ta) when the ambient temperature is higher than the switch temperature Tm (step 82). A relation between these may be found in advance for each type of the rotor 1 and may be stored in a storage device not shown in the control device 14. In this case, the control device 14 simply reads the stored relation, thereby achieving quick processing. Next, the control device 14 measures the ambient temperature (room temperature) Ta by using the temperature sensor 15 (step 83) to determine whether the ambient temperature Ta exceeds the switch temperature Tm (step 84). Here, when the ambient temperature Ta does not exceed the switch temperature Tm, an operation of centrifugation is performed with the upper-limit value $F_{cmax}$ being set at 75 Hz, and the procedure then returns to step 81 (step 85).

When the ambient temperature Ta exceeds the switch temperature Tm at step 84, it is determined whether this case applies to a reduction exclusion condition in which reduction of $F_{cmax}$ is not required. Here, it is determined whether a centrifugal remaining time τ(c) is shorter than the remaining time of a predetermined centrifugal time (for example, three minutes, which can be set so as to vary based on the centrifugal condition) (step 86). When the centrifugal remaining time τ(c) is shorter than the predetermined centrifugal time, for example, when the procedure ends in substantially several minutes, while there is a concern about an increase in temperature of the compressor 7*b*, the temperature does not reach the compressor's upper-limit temperature 32 even if operation is continued with $F_{cmax}$ being kept at 75 Hz. Therefore, the procedure returns to step 83, with $F_{cmax}$ being kept at 75 Hz (step 87). Note that substantially how long the centrifugal remaining time τ(c) is preferably found in advance by an experiment according to the type of the rotor 1 for use and stored in the storage device in the control device 14. With this, by performing control of forcible operation without reduction in temperature when the remaining time of centrifugation operation is short, the need to decrease the capability of the compressor 7*b* immediately before the end can be eliminated.

When the centrifugal remaining time τ(c) is longer than the predetermined centrifugal time, the rotational-frequency upper-limit value 33 or 63 of the compressor 7*b* is required to be reduced. Therefore, the upper-limit value $F_{cmax}$ is calculated by using the predetermined function f(Ta) (step 88). Here, user's attention is called by causing a message indicating that "the freezing device in restricted operation" to be displayed on the operation panel 13 (step 89).

As described above, in the second embodiment, the upper-limit value of the compressor's rotation frequency is changed according to the mounted rotor 1. Therefore, the compressor 7*b* can be efficiently operated at a temperature lower than or equal to the set upper-limit temperature of 100° C. Also, the relation between the rotor and the compressor's upper-limit rotation frequency is found in advance and stored in the storage device in the control device. Therefore, by obtaining the ambient temperature and the rotor ID, the control device can instantaneously find the operation condition of the compressor 7*b*. Furthermore, when restricted operation to reduce the compressor's upper-limit rotation frequency is performed, whether to perform restriction is determined in consideration of the remaining time of the operation of centrifugation. Therefore, restriction immediately before the end of the operation of centrifugation can be prevented, and the operation of centrifugation can be completed with the cooling capability being kept.

As described above, the upper-limit rotation frequency is set for each type of the identified rotor. Therefore, even if the rotor is replaced, it is possible to make the most of the capability of the compressor. Since the setting conditions of the upper-limit rotation frequency according to the ambient temperature are stored in advance in the storage device for each type of the rotor, the upper-limit rotation frequency according to the rotor can be quickly selected and set. Also, when the upper-limit rotation frequency is set, the control device does not have to execute an arithmetic expression. In addition, any upper-limit rotation frequency to be stored in the storage device can be set in a plurality of stages for each fine temperature range. Thus, it is possible to support various cases and accurately manage upper-limit rotational frequencies. When the upper-limit rotation frequency is decreased, the control device causes a message to be displayed on the display device, indicating that the compressor is being operated in a restricted state. Thus, the user can easily know that the cooling device is being operated with its capability being restricted. Furthermore, if information about how to cancel the restriction (a solving method) is displayed to the user, a more user-friendly centrifuge can be achieved. When the upper-limit rotation frequency is decreased, it is determined the remaining centrifugation operation time is within the predetermined time and, when the remaining time is within the predetermined time (for example, within several minutes), the operation of the compressor is continued without decreasing the upper-limit rotation frequency. This can prevent a decrease in capability of the compressor immediately before the end of the operation of centrifugation.

While the present invention has been described above based on the embodiments, the present invention is not meant to be restricted to the embodiments described above, and can be variously changed within a range not deviating from the gist of the present invention. For example, while the upper-limit rotation count of the compressor 7*b* is controlled with the ambient temperature in the embodiment described above, a temperature sensor for measuring the temperature of the compressor 7*b* may be further added, and the freezing device may be operated according to the ambient temperature and the actual temperature of the compressor 7*b*. Also, while the compressor's rotational-frequency upper-limit value when the ambient temperature is higher than the switch temperature Tm is found by a negative linear function, the compressor's rotational-frequency upper-limit value may be found by not only a linear function but also another function expression. Furthermore, the compressor's rotational-frequency upper-limit value may be calculated without using the switch temperature Tm, and may be calculated using a function over the entire region of the operating temperature of the centrifuge. Still further, not one but a plurality of switch temperatures Tm may be provided, and the upper-limit frequency may be set by using a plurality of functions in a plurality of temperature ranges.

Further, the shape of the freezing device 7 is not limited to that described above and it may be such that a connection is made by a bypass not illustrated that short-circuits copper tubes adjacent near the arrow and the arrow b in FIG. 1 and an electromagnetic valve (not illustrated) is provided in the middle of the bypass so that the control device 14 controls the electromagnetic valve to control switching of conduction and cut off of the short-circuited path by the bypass. If the bypass is provided, a refrigerant which outflows from the condenser 7*a* can be allowed to flow directly into the compressor 7*b* via the bypass without passing through the part wrapped round the outer circumference of the bowl 2. Thus, various types of control of the freezing device 7 using the bypass are available.

Third Embodiment

Next, with reference to FIGS. 7 to 11, a third embodiment of the present invention is described. In the third embodiment, when a user inputs operation conditions (set data) of centrifugation operation, a control device 14 determines whether the operation conditions are appropriate referring to conditions of an attached rotor and current room temperature, and when it determines that the operation conditions are not appropriate, asks the user if he/she wishes to reset suitable operation conditions. Here, upon performing centrifugation operation, it is necessary to enable operation by controlling the compressor 7*b* not to abnormally heated by lowering the rotation speed of a motor to reduce windage loss of a rotor 1, raising a setting temperature to make the operation conditions fall within the capacity of the compressor 7*b*, or other methods so that operation is enabled. Accordingly, upon resetting the operation conditions, information required to modify conditions is provided to the user so that usability of the centrifuge is further improved.

Figure 7:
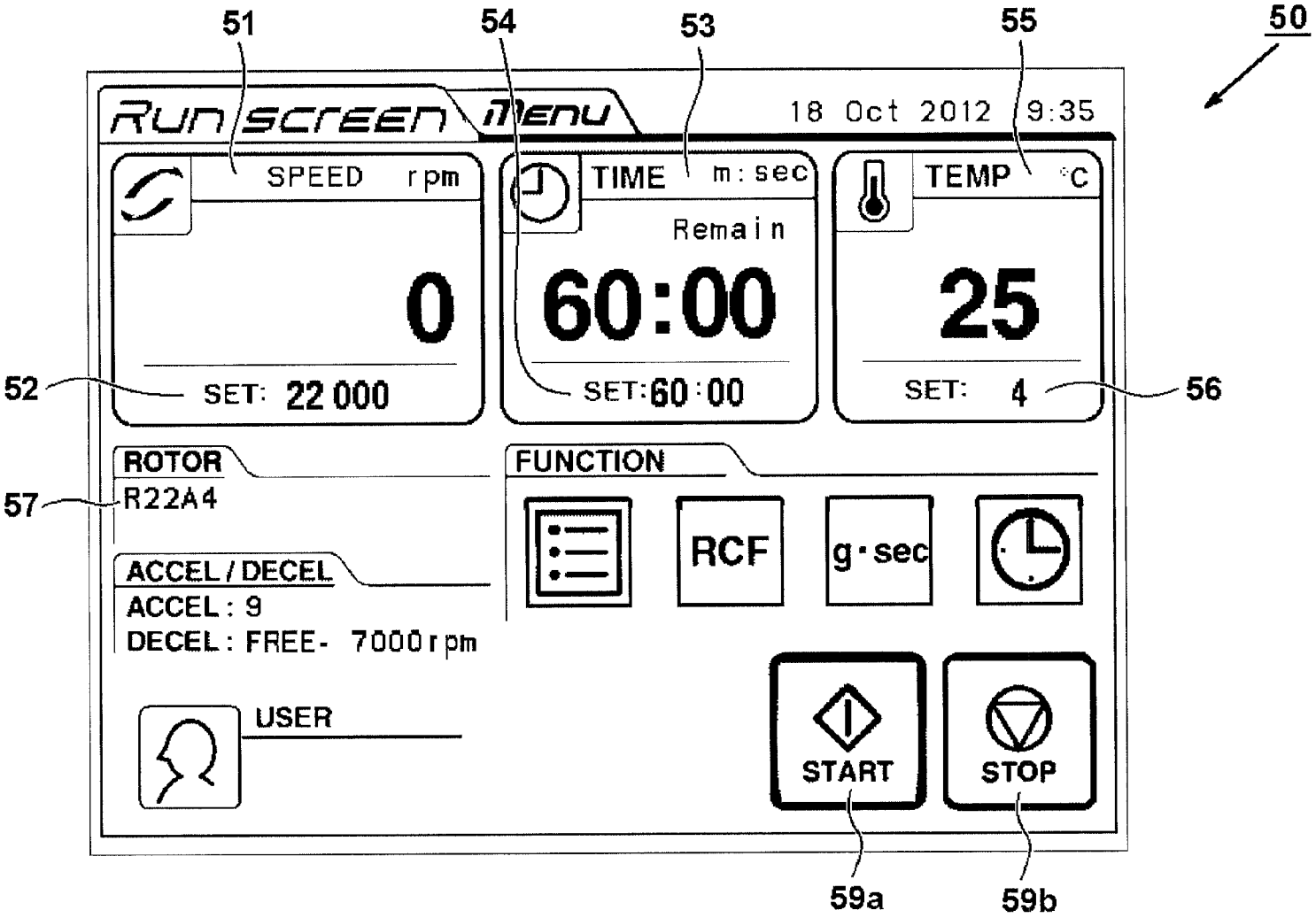
FIG. 7 is a diagram of a display screen of a centrifuge according to a third embodiment of the present invention, illustrating a situation immediately after a user inputs operation conditions.

FIG. 7 is a diagram illustrating an example of a display screen 50 of an operation panel 13. In FIG. 7, a state immediately before a user inputs a sequential operation conditions, in which a start icon 59*a* has not been pushed. Here, FIG. 7 depicts that the user sets the setting rotation speed 52 of the rotor to 22,000 rpm, a setting operation time 54 is set to 60 minutes and 00 second, and a setting temperature 56 is 4° C. Here, since the situation is before pushing the start icon 59*a*, the operation rotation speed 51 is 0, a remaining operation time display unit 53 indicates 60 minutes and 00 second same as the setting operation time 54, and 25° C. that is temperature of the current rotor chamber 3 or the rotor 1 is displayed as current temperature 55. The temperature of the rotor 1 is, for example, indirectly measured according to a temperature sensor (not illustrated) provided to a bottom portion of the bowl 2, when the centrifuge is activated after a long-time abeyance, temperature of the rotor chamber is at a value close to the outside temperature. Note that a method of directly or indirectly measuring temperature of the rotor has been known and thus detailed description thereof will be omitted. A rotor information display unit 57, the start icon 59*a* and the stop icon 59*b* etc. for displaying an identified type of the motor 1 are displayed on the display screen 50; meanwhile, arrangement of the parts, contents to be displayed, and an operation method are the same as those of the first embodiment described with reference to FIG. 4.

Here, in such environment that an ambient temperature (outside air temperature) measured by a temperature sensor 15 is higher than or equal to a predetermined temperature and current operation conditions set by the user are not operable because the temperature of the compressor is going to be raised, user is prompted to pay attention by a message or alarm sound etc. FIG. 8 depicts an example of the message. In FIG. 8, a message 150 is displayed near the center of the screen of the display screen 50 and it is preferable if alarm sound such as that of a buzzer is played along upon display of the message. The message 150 is displayed being overlapped with the display screen in FIG. 7, and displayed as a pop-up screen. The display is monochrome in the example of FIG. 8 and thus the notification of the message is difficult to find; however, actually, it is preferable to let users notice that a message is shown at a glance by using color display or gray scale display. The contents of the message 150 include "currently set operation conditions are not operable" and detailed contents showing details thereof are displayed as message text 151, and also an icon for confirming willingness for letting the user to input willingness of the user to the message text 151, that is, YES icon 152 and NO icon 153 are displayed. Here, when the user wishes to operate after changing the operation conditions, the user touches the YES icon 152. When the user wishes to operate without changes, the user touches the NO icon 153. Here, when the user touches the NO icon 153, the screen returns to the input screen in FIG. 7 and each of the operation conditions can be reset. Note that, a "force operation" icon for forcibly performing with the set operation conditions may be provided inside the message 150 so that centrifugation operation is started with the conditions unchanged if the user has selected the force operation icon.

Figure 9:
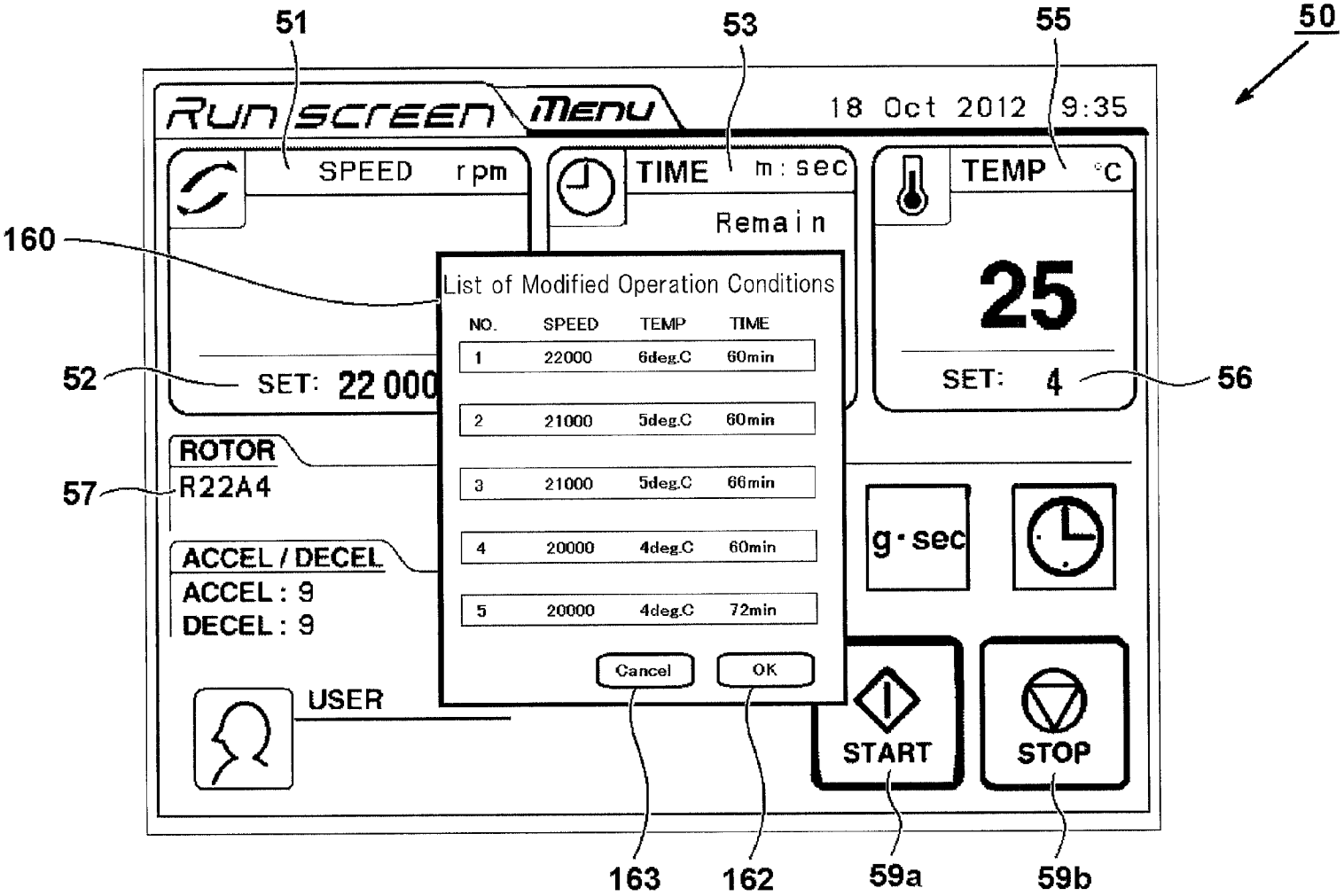
FIG. 9 is a diagram illustrating a display screen of a centrifuge according to the third embodiment of the present invention, illustrating a state in which a list of candidate operation conditions is displayed.

FIG. 9 is a subsequent display screen in a situation in which the user touches the YES icon 152. Here, a candidate list of operation conditions 160 is displayed in a pop-up style near the screen center of the display screen 50. Here, a list of a plurality of operation conditions (modified operation conditions) operable by processing in a microcomputer included in the control device 14 is displayed. Five candidates are displayed here as the modified operation conditions, in each of which a rotation speed, setting temperature of the rotor, and centrifugation operation time are displayed. The modified operation conditions are calculated by an operation (calculation) by the microcomputer included in the control device 14 in consideration of a set type of the rotor, outside temperature, capacity of the freezing device, etc. Here, in the first modified operation conditions, the rotation speed is maintained at the one set by the user and it indicates that the setting temperature of the rotor becomes 6° C. in this case. In this case, since the operation time is maintained at 60 minutes set by the user because the operation speed is not changed. Next, in the fifth modified operation conditions, the case in which the temperature of the rotor is maintained at temperature (4° C.) set by the user is indicated. In this case, the rotation speed of the rotor becomes 20000 rpm and it indicates that the centrifugation operation time is increased to 72 minutes along with lowering of the rotation speed. Among the modified operation conditions, the second to fourth candidates are modification examples which may be called compromise plans between the first and fifth candidates. Here, as the actual display screen 50 is displayed with colors, when the conditions set by the user in the candidate list of operation conditions 160, that is, only the portions of 22000 rpm of rotation speed, 4° C. of temperature, 60 min of time are displayed with red letters, highlight, bold letters or else to be differed from the other display aspects, the user can quickly recognize the original operation conditions inputted by the user. Thus, the centrifuge becomes easy-to-use.

In this manner, either one of the conditions inputted from the candidate list of operation conditions 160 is selected. Here, the fourth candidate is selected for example and when the OK icon 162 is touched the popped-up candidate list of operation conditions 160 goes out and the conditions of the selected fourth candidate are inputted, and the setting rotation speed 52 is changed from 22000 to 20000. Then, as the user touches the start icon 59*a*, the centrifugation operation is started. Note that, regarding the display screen 50 in FIG. 9, when the user determines that any candidate in the candidate list of operation conditions 160 is not favorable, the user touches the cancel icon 163 and then the state transferred to that in FIG. 7. Thus, the operation conditions can be inputted again.

Figure 10:
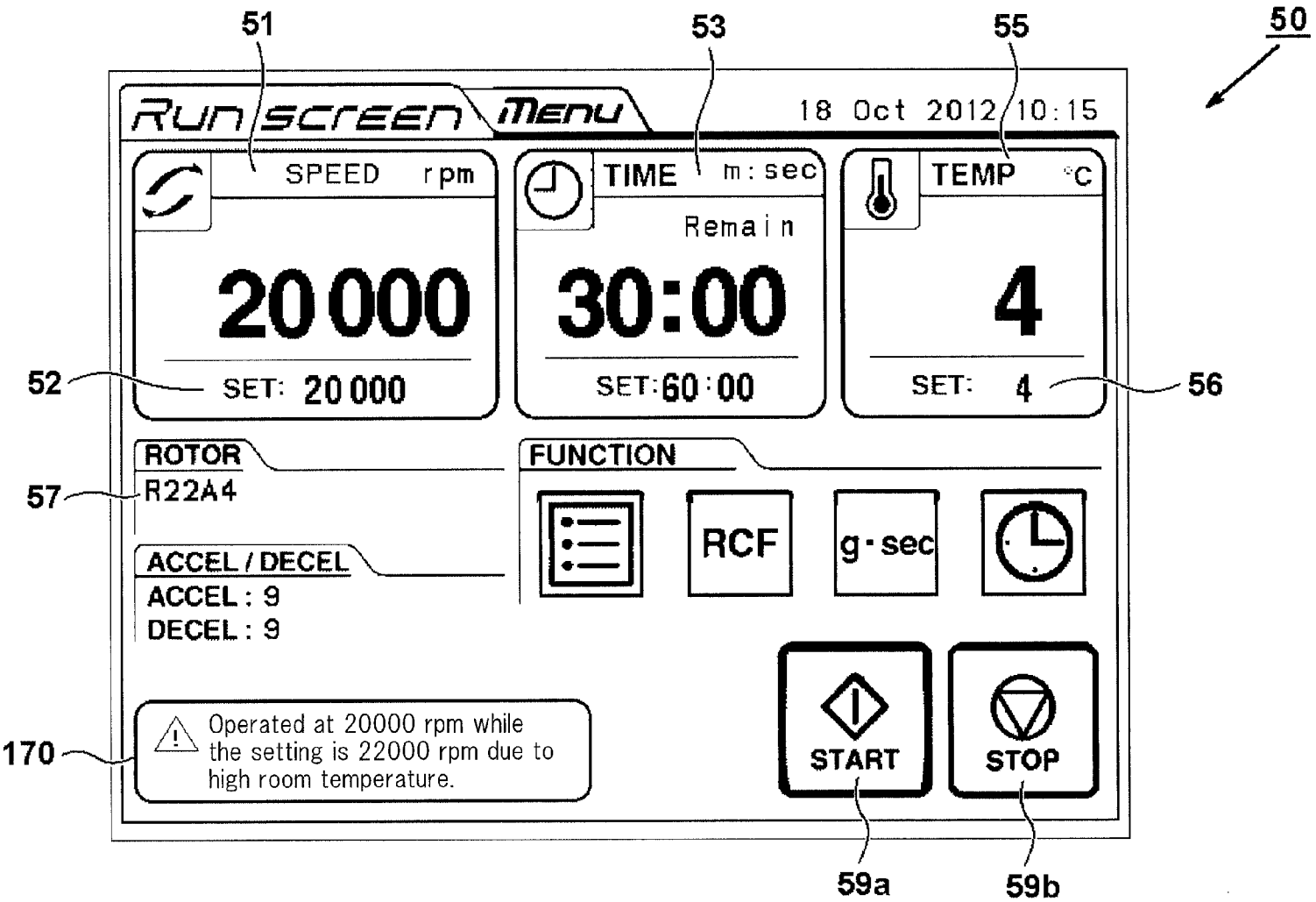
FIG. 10 is a diagram illustrating a display screen of a centrifuge according to the third embodiment of the present invention, illustrating a state during operation with modified operation conditions.

FIG. 10 is a diagram illustrating the display screen 50 in a state where the rotor has been rotated at a high speed for 30 minutes. During the operation, a message "Operated at 20000 rpm while the setting is 22000 rpm due to high room temperature." is displayed in a message display portion 170. It is important about this display to make the modified contents instantly recognizable to the user and thus the message contents include both initial operation conditions and modified operation conditions here. Note that, at this moment, the message for requesting improvement to the user "Room temperature is over 25° C. Freezing device is in restricted operation. Please lower room temperature" may be displayed together in the same manner as the first embodiment illustrated in FIG. 4.

Figure 11:
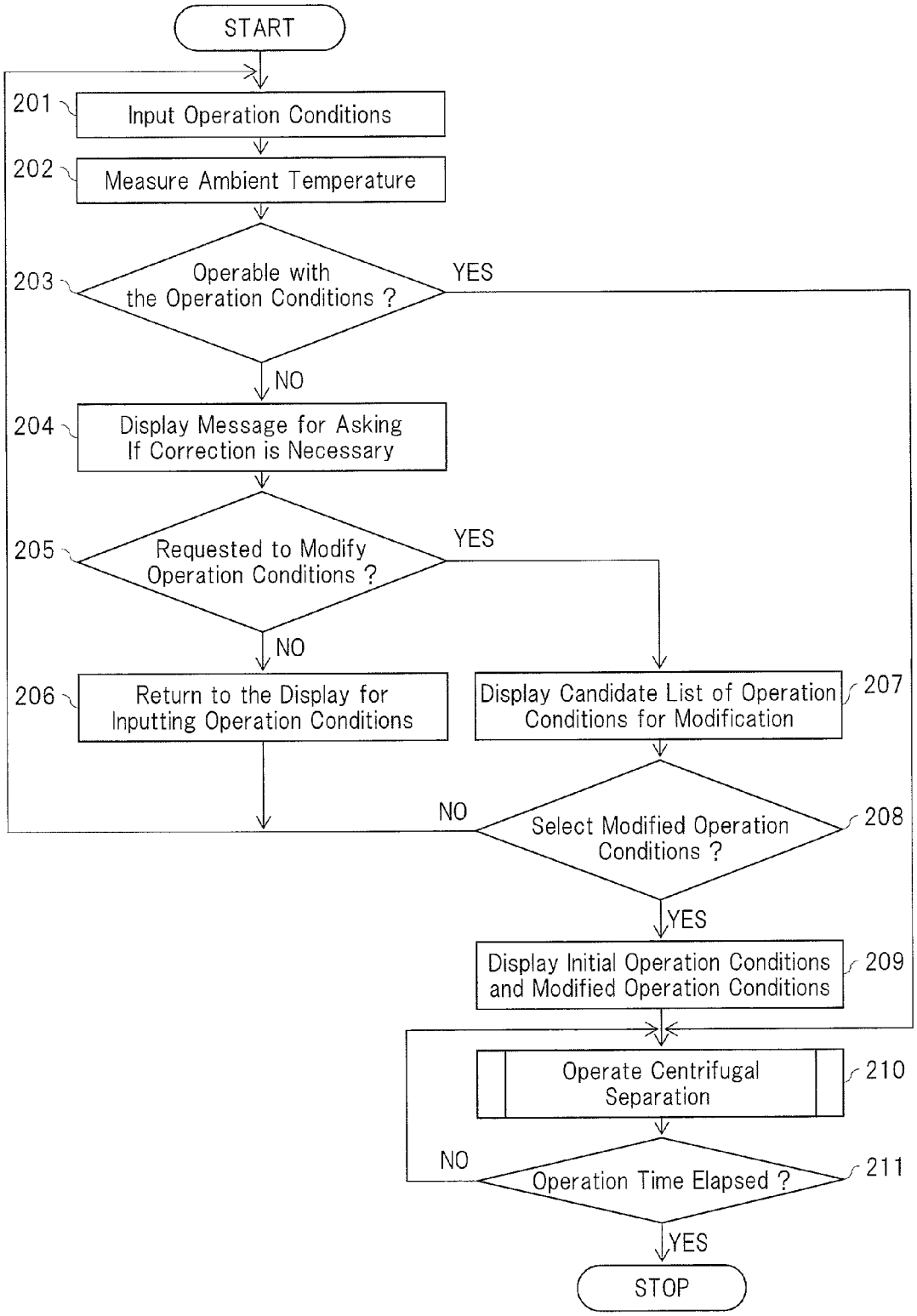
FIG. 11 is a flowchart of a control procedure of the centrifuge according to the third embodiment of the present invention.

Next, with reference to the flow chart in FIG. 11, a control procedure of the centrifuge according to the third embodiment will be described. The user sets the rotor 1 to which a container including a sample inside the rotor chamber 3 of the centrifuge. Then, after the door 5 is shut and operation conditions are inputted via the operation panel 13, the procedure in FIG. 11 is started. The sequence of procedure illustrated in FIG. 11 is operable in terms of software according to program previously stored in the memory device (not illustrated) of the control device 14.

The user inputs operation conditions such as a rotation speed, temperature, rotor, and so forth from the operation panel 13 in FIG. 1 (step 201). The method of inputting operations and so forth are same that described in the first embodiment. Next, the control device 14 measures ambient temperature (outside temperature) of the centrifuge using a temperature sensor 15 (step 202) and determines whether the centrifuge is operable under the set operation conditions with respect to the measured ambient temperature or not. As described in the first embodiment, when the room temperature is high exceeding performance warranty temperature (15° C. to 25 C.°) which warranties temperature control of the rotor 1 within specifications, whether continuously operable or not is often a problem. Thus, in consideration of the upper-limit rotation frequency described in FIGS. 2 and 5, the control device 14 determines whether the operation is operable or not with reference to set operation conditions (step 203). In the step 203, when the operation is operable, the procedure advances to step 210 and processing of normal centrifugation operation is started. In step 210, cooling of the rotor 1 at the set temperature by the freezing device 7 performed in normal centrifuge 210 and control of the centrifuge normally performed such as rotation control of the motor 4 for accelerating-setting-decelerating the rotor 1 are performed. However, as a known procedure can be used as the control procedure of step 10 as it is, detailed descriptions of the procedure will be omitted.

When the centrifugation operation is inoperable in step 203, the control device display the message 150 popped up on the display screen 50 of the operation panel 13 as illustrated in FIG. 8 so that what kind of problem (operation is unavailable under operation conditions initially set by the user due to high room temperature) occurs and options to select for confirming the user whether he/she wishes to continue operation in response to the problem are displayed. The options may be such an extent of the YES-NO choice but other methods than that may be used for asking if the worker is willing to modify or not. Note that, transition from step 201 to steps 202 and 203 may be automatically performed when the setting rotation speed 52, setting operation time 54 and setting temperature 56 are inputted or may be performed when the user touches the start icon 59*a* after the input of the setting rotation frequency 52, setting operation time 54 and setting temperature 56.

Next, the control device 14 acquires a choice by the user from the operation panel 13. When there is no selection by the user, the procedure returns to step 201 (step 206) and the input screen of operation conditions (RunScreen) illustrated in FIG. 7 is displayed to invite the user to reenter operation conditions. When there is a selection by the user from the operation panel 13, it indicates willingness of modification in step 205, that is, when the user touches the YES icon 152 provided within the frame of the message 150 on the display screen 50 in FIG. 8, the candidate list of operation conditions 160 in FIG. 9 is displayed on the operation panel 13 (step 207). Next, the control device 14 determines what the user selected from the modified operation conditions (step 208).

In step 208, when the user does not select a candidate of modified operation conditions, that is, in the display screen 50 in FIG. 9, when the user touches the cancel icon 163, the procedure returns to step 201 and the input screen of operation conditions (RunScreen) illustrated in FIG. 7 is displayed and thus the user can reenter operation conditions. In step 208, when the user selects either one of the candidates of modified operation conditions, that is, when either one candidate of the first to fifth modified operation conditions is touched by the user and the display of the candidate is highlighted. Then, when the OK icon 162 is touched, the selected modified operation conditions are displayed on the display screen 50 as illustrated in FIG. 10. More particularly, when the fourth candidate in the candidate list of operation conditions 160 is selected, the setting rotation speed 52 is automatically changed from 22000 rpm in FIG. 7 to 20000 rpm. As the setting operation time 54 and the setting temperature 56 are not changed, the display remains the same. Further, as illustrated in FIG. 10, near the lower left corner of the display screen 50, a message calling for attention is displayed, for example, "Operated at 20000 rpm while the setting is 22000 rpm due to high room temperature." (step 209). In the message calling for attention, the initial operation conditions (setting operation speed=22000 rpm) are included and displayed (step 209). In this manner, by displaying including the initial operation conditions, during the operation, the user can easily recognize that the initial operation conditions have been changed. Next, in step 210, the normal operation procedure of the centrifuge after inputting operation conditions is performed, and when the setting operation time has elapsed (step 211), the processing of FIG. 11 is terminated.

As described in the foregoing, according to the third embodiment, even in bad conditions such as the ambient environment (e.g., room temperature) exceeding performance warranty temperature for the centrifuge, by displaying the message 150 on the operation panel 13 of the centrifuge, it is possible to show the user that there is a possibility that the temperature of the rotor does not fall within the specifications. Further, when the user still wishes to perform the operation, the candidate list of operation conditions are shown to the user to let the user input or select modified operation conditions. Thus, the user can easily learn operable conditions and easily modify the operation conditions. In this manner, an easy-to-use centrifuge can be achieved.

Note that, the display method on the display screen 50 for selecting the modified operation conditions described in the third embodiment is not limited to the example described above and may be another method to achieve the selection. For example, in the message 150 in FIG. 8, four icons, "continue operation (reduce the rotation speed to 20000 rpm)", "continue operation (raise the temperature to 6° C.)", "force operation", "cancel" may be displayed so that modified operation conditions can be selected directly from the display.

In addition, as another function of the centrifuge, when a cause by which the operation conditions must be modified is eliminated during operation of the centrifuge under the modified operation conditions according to the third embodiment, for example, when the centrifuge is not operable under the initial operation conditions due to too high room temperature, the control device 14 may automatically modify the modified operation conditions to the initially set operation conditions in the middle of centrifugation operation when the room temperature is sufficiently lowered as the air conditioner of the room works. As to this automatic modification, the user may be allowed to previously set whether an automatic modification is performed to each of the setting items (setting rotation speed, setting operation time, setting time). Although a minority of users may wish to automatically modify in the middle of the setting rotation speed and setting operation time, there may be many users who wish to make only the setting temperature to be automatically modified into the initially set operation conditions during operation. According to the present configuration, the operation conditions set in the centrifuge inconsideration of bad conditions are automatically switched in accordance with the ambient environment without resetting by the user. Thus, time and effort to change the operation conditions by the user can be eliminated.

In the foregoing, the present invention has been described with reference to the first to third embodiment. Particularly, while the cooling capacity of the freezer has been specifically described, for example, the cooling capacity during operation of the motor is affected by the room temperature. When operation is performed with high temperature and high load, it is considerable that the motor is put in a high temperature state. In such a case, based on the room temperature and set operation conditions, the control device determines operable or not; when it is determined to be inoperable, an alarm for notifying the inoperability or notification may be displayed on the display device to invite the user to change the operation conditions.

What is claimed is:

1. A centrifuge comprising:

a motor;

a rotor mounted on a rotating shaft of the motor;

a rotor chamber accommodating the rotor;

a cooling device including a variable-speed-controllable compressor set with an upper-limit rotation frequency and a lower-limit rotation frequency and cooling the rotor chamber;

an inputting unit inputting operation conditions including setting temperature and setting rotation speed of the rotor;

a temperature measuring unit measuring ambient temperature of the centrifuge; and a control device controlling operation of the motor and the cooling device, wherein the control device sets a switch temperature Tm for switching the upper-limit rotation frequency, the upper-limit rotation frequency is set to have a constant value when the measured ambient temperature is lower than or equal to the switch temperature Tm, and the upper-limit rotation frequency is decreased from the constant value when the measured ambient temperature exceeds the switch temperature Tm.

2. The centrifuge according to claim 1, the type of the rotor to be used can be inputted to the inputting unit, and the control device determines the operability based on the type of the rotor inputted to the inputting unit.

3. The centrifuge according to claim 1, further comprising a rotor determining unit, wherein the control device determines the operability based on the type of the rotor determined by the rotor determining unit.

4. The centrifuge according to claim 2, the control device determines the operability before start of operation of the motor.

5. The centrifuge according to claim 1, further comprising a display device, wherein, when the inputted operation conditions are inoperable, the control device causes the display device to display that the operation conditions are inoperable.

6. The centrifuge according to claim 1, wherein, when the control device determines that the operation conditions inputted in the inputting unit are inoperable, the control device causes the display device to display for inviting resetting of the operation conditions.

7. The centrifuge according to claim 6, wherein, the control device invites a user to select necessity of modification of the operation conditions.

8. The centrifuge according to claim 7, wherein when the user selects "necessary" regarding the modification of the operation conditions, the control device causes the display device to display modified operation conditions, which are candidates of operable operation conditions, including a combination of a setting rotation speed and a setting time, and accepts a selection from the candidates by the user.

9. The centrifuge according to claim 8, the modified operation conditions include a combination of the setting rotation speed and setting time of the rotor and setting temperature of the rotor chamber.

10. The centrifuge according to claim 8, wherein the control device displays plans of the modifies operation conditions, and performs centrifugation operation in accordance with modified operation conditions the user selects from the plans.

11. The centrifuge according to claim 10, wherein the modified operation conditions include:

a plan with the rotation speed being reduced and the setting time elongated; and a plan with the rotation speed and the setting time being maintained and the setting temperature being raised.

12. The centrifuge according to claim 10, wherein, when centrifugation operation is performed using the modified operation conditions, the control device causes the display device to display information indicating that the operation is being performed under the modified operation conditions.

13. The centrifuge according to claim 12, wherein, during the centrifugation operation using the modified operation conditions, when operation conditions initially set by the user becomes operable, the control device changes the modified operation conditions into the initially set operation conditions to perform the centrifugation operation under the initially set operation conditions.

14. The centrifuge according to claim 7, wherein, when the user selects continuing the operation upon displaying the operation conditions being inoperable, the control device causes, during the centrifugation operation, the display device to display information indicating that the operation conditions are inoperable and also display conditions for improving an inoperable situation.

15. The centrifuge according to claim 1, wherein when controlling the cooling device, an upper-limit rotation frequency of the compressor is set in accordance with the measured ambient temperature.

16. The centrifuge according to claim 1, wherein the control device calculates the upper-limit rotation frequency with a function equation of the ambient temperature when the measured ambient temperature exceeds the switch temperature Tm.

17. The centrifuge according to claim 1, further comprising an identifying unit identifying a type of the rotor mounted on the rotating shaft, wherein the upper-limit rotation frequency of the compressor is set for each type of the identified rotor.

18. The centrifuge according to claim 1, wherein the control device has a storage device, a setting condition of the upper-limit rotation frequency according to the ambient temperature is stored in advance in the storage device for each type of the rotor, and the control device identifies the type of the mounted motor, and reads a setting condition of the upper-limit rotation frequency of the compressor of the identified rotor from the storage device to operate the cooling device.

19. The centrifuge according to claim 1, further comprising a display device displaying information indicating an operation state, wherein the control device causes the display device to display that the compressor is being operated in a restricted state when the upper-limit rotation frequency is decreased.

20. The centrifuge according to claim 1, wherein the control device determines whether a remaining centrifugation operation time is within a predetermined time, and decreases the upper-limit rotation frequency when exceeding the predetermined time.

* * * * *